US008944038B2

(12) United States Patent
Bednar et al.

(10) Patent No.: US 8,944,038 B2
(45) Date of Patent: Feb. 3, 2015

(54) CROSSBOW RISER

(75) Inventors: Richard L. Bednar, Munroe Falls, OH (US); Richard W. Gardner, Norton, OH (US); Michael J. Shaffer, Mogadore, OH (US)

(73) Assignee: Hunter's Manufacturing Co., Inc., Suffield, OH (US)

( * ) Notice: Subject to any disclaimer, the term of this patent is extended or adjusted under 35 U.S.C. 154(b) by 165 days.

(21) Appl. No.: 13/608,548

(22) Filed: Sep. 10, 2012

(65) Prior Publication Data

US 2013/0061837 A1 Mar. 14, 2013

Related U.S. Application Data

(60) Provisional application No. 61/532,600, filed on Sep. 9, 2011.

(51) Int. Cl.
*F41B 5/12* (2006.01)

(52) U.S. Cl.
CPC ..... *F41B 5/123* (2013.01)
USPC ..... 124/25

(58) Field of Classification Search
CPC ..... F41B 5/10; F41B 5/12; F41B 5/123; F41B 5/14
USPC ..... 124/23.1, 25, 25.6, 86, 88
See application file for complete search history.

(56) References Cited

U.S. PATENT DOCUMENTS

| | | | | |
|---|---|---|---|---|
| 3,991,248 | A * | 11/1976 | Bauer | 442/148 |
| 7,699,045 | B1 * | 4/2010 | Kronengold et al. | 124/25.6 |
| 7,918,218 | B1 * | 4/2011 | Kronengold et al. | 124/23.1 |
| 8,627,810 | B2 * | 1/2014 | McPherson | 124/23.1 |

* cited by examiner

*Primary Examiner* — John Ricci
(74) *Attorney, Agent, or Firm* — Emerson Thomson Bennett

(57) ABSTRACT

Provided is a crossbow riser that may comprise a plurality of cells defined by walls. The walls may consist essentially of a material wherein the yield tensile strength at 0.2% strain is greater than 780 MPa, and either the specific strength is greater than 200 kN·m/kg, or the density is less than 6.0 g/cc. The cells may collectively define a first volume. The walls may collectively define a second volume. The ratio of the first volume to the second volume may be greater than 1.5.

20 Claims, 22 Drawing Sheets

CROSSBOW RISER

CROSS-REFERENCE TO RELATED APPLICATIONS

This application claims the benefit of U.S. Provisional Application No. 61/532,600, filed Sep. 9, 2011. All of the subject matter disclosed by U.S. Provisional Application No. 61/532,600 is hereby incorporated by reference into this application.

BACKGROUND

A. Field of Subject Matter

This subject matter relates to apparatuses and methods regarding crossbows and more specifically to apparatuses and methods regarding a crossbow riser.

B. Description of the Related Art

Crossbows have been used for many years as a weapon for hunting and fishing, and for target shooting. In general, a crossbow may include a main beam including a stock member and a barrel connected to the stock member. The barrel may include an arrow receiving area for receiving the arrow that is to be shot. The crossbow may also comprise a bow assembly supported on the main beam that may include a bow and a bowstring connected to the bow for use in shooting arrows. A trigger mechanism, also supported on the main beam, holds the bowstring in a drawn or cocked condition and can thereafter be operated to release the bowstring from the cocked to an uncocked condition to shoot the arrow.

One of the trends in the industry today is to provide crossbows with high draw weight. Providing high draw weight provide the potential for more speed and energy. But there are corresponding problems. One such problem is that the components of the crossbow must be made strong enough to support the high draw weight. Because making components stronger can creates additional problems related to component cost or weight, strengthening components of a crossbow must be balanced against concerns of cost and weight.

SUMMARY

This Summary is provided to introduce a selection of concepts in a simplified form that are further described below in the Detailed Description. This Summary is not intended to identify key factors or essential features of the claimed subject matter, nor is it intended to be used to limit the scope of the claimed subject matter.

Disclosed is a crossbow riser that may comprise a plurality of cells defined by walls. The walls may consist essentially of a material wherein the yield tensile strength at 0.2% strain is greater than 780 MPa, and either the specific strength is greater than 200 kN·m/kg, or the density is less than 6.0 g/cc. The cells may collectively define a first volume. The walls may collectively define a second volume. The ratio of the first volume to the second volume may be greater than 1.5.

Also disclosed is a crossbow comprising a bowstring movable between a cocked position and an uncocked position. The cocked position defines an operational plane. The crossbow may comprise a riser comprising a planar upper surface substantially parallel to the operational plane and a planar lower surface. The crossbow may also comprise a set of one or more cells defined by a set of one or more walls. Each of the one or more cells may be in communication with both the upper surface and the lower surface. Each of the set of one or more cells and the set of one or more walls has a cross-sectional area defined by a sectional plane parallel to the upper surface that is substantially constant along a dimension normal to the upper surface. The ratio of the area of the set of one or more cells to the area of the set of one or more walls may be greater than 1.5.

Also, disclosed is a crossbow riser having a bulk density that may be less than 4.5 g/cc.

BRIEF DESCRIPTION OF THE DRAWINGS

The subject matter may take physical form in certain parts and arrangement of parts implementations of which will be described in detail in this specification and illustrated in the accompanying drawings which form a part hereof and wherein.

DEFINITIONS

Figure 1:
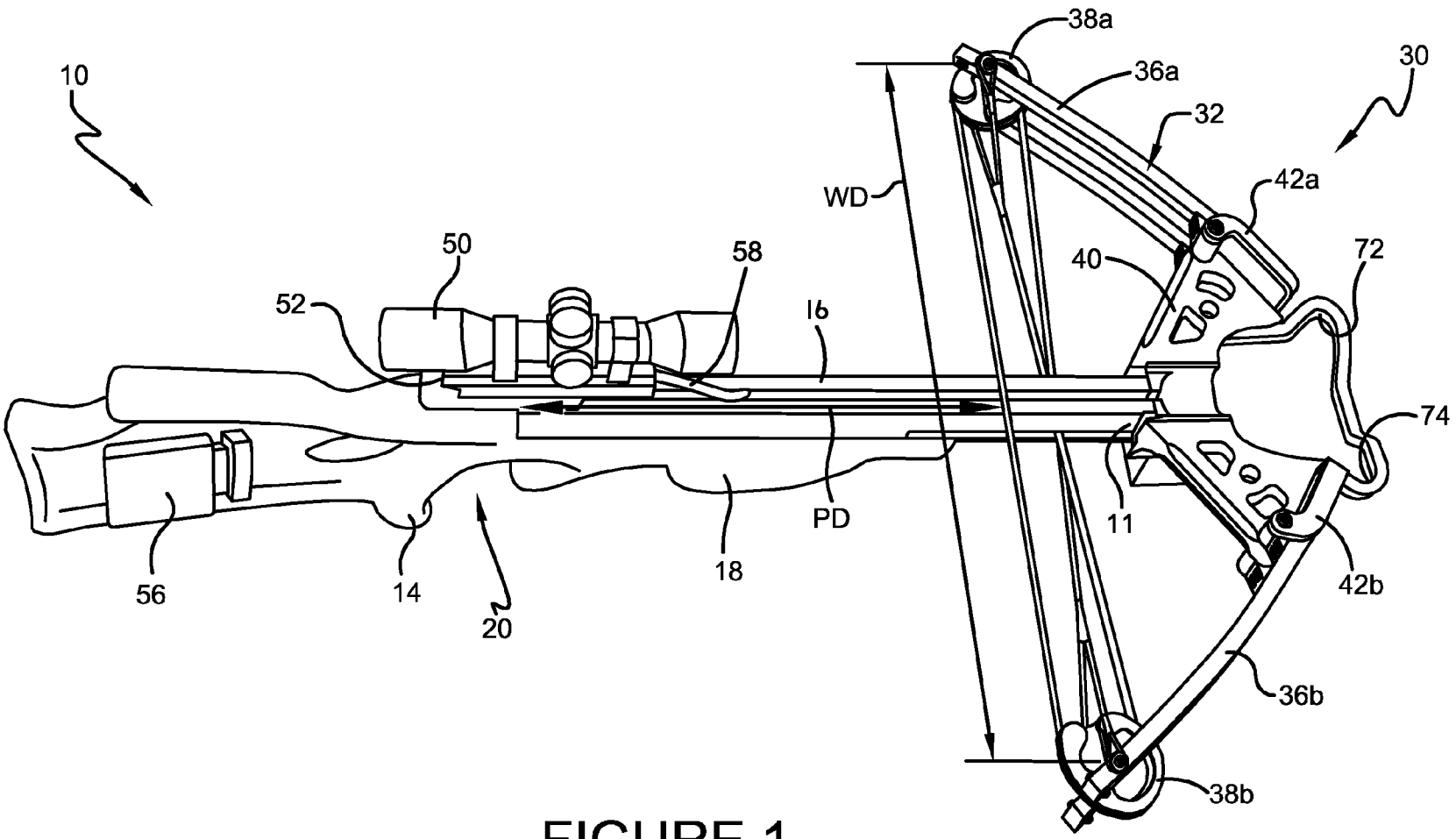
FIG. 1 is a component diagram illustrating a top perspective view of an example implementation of a crossbow.

The following definitions are controlling for the disclosed subject matter:

"Arrow" means a projectile that is shot with (or launched by) a bow assembly.

"Bow" means a bent, curved, or arched object.

"Bow Assembly" means a weapon comprising a bow and a bowstring that shoots or propels arrows powered by the bow and the drawn bowstring.

"Bowstring" means a string or cable attached to a bow.

"Compound Bow" means a crossbow that has wheels, pulleys or cams at each end of the bow through which the bowstring passes.

"Crossbow" means a weapon comprising a bow assembly and a trigger mechanism both mounted to a main beam.

"Draw Weight" means the amount of force required to draw or pull the bowstring on a crossbow into a cocked condition.

"Limbs" mean the stiff elongated elements attached at either end of the riser which are elastically bent when the bow is drawn to store elastic energy.

"Main Beam" means the longitudinal structural member of a weapon used to support the trigger mechanism and often other components as well. For crossbows, the main beam also supports the bow assembly. The main beam often comprises a stock member, held by the person using the weapon, and a barrel, used to guide the projectile being shot or fired by the weapon.

"Power Stroke" means the linear distance that the bowstring is moved between the uncocked condition and the cocked condition.

"Riser" means the middle part of the bow having two ends to which the limbs of the bow may be attached.

"Trigger Mechanism" means the portion of a weapon that shoots, fires or releases the projectile of a weapon. As applied to crossbows, trigger mechanism means any device that holds the bowstring of a crossbow in the drawn or cocked condition and which can thereafter be operated to release the bowstring out of the drawn condition to shoot an arrow.

"Weapon" means any device that can be used in fighting or hunting that shoots or fires a projectile including bow assemblies and crossbows.

DETAILED DESCRIPTION

The claimed subject matter is now described with reference to the drawings, wherein like reference numerals are generally used to refer to like elements throughout. In the following description, for purposes of explanation, numerous specific details are set forth in order to provide a thorough understanding of the claimed subject matter. It may be evident, however, that the claimed subject matter may be practiced without these specific details. In other instances, structures and devices are shown in block diagram form in order to facilitate describing the claimed subject matter.

Referring now to the FIGS. 1-22 wherein the diagrams are for purposes of illustrating multiple disclosures of the subject matter only and not for purposes of limiting the same, FIGS. 1-22 show a first implementation of a crossbow 10. While the crossbow shown uses a compound-style bow, it should be understood that this subject matter will work well with any type of crossbow chosen with sound judgment by a person of ordinary skill in the art. As illustrated in FIGS. 1-4, a crossbow 10 can comprise a main beam 12, which can include a stock member 14 and a barrel member 16. In one implementation, the main beam 12 may comprise the stock member 14 and the barrel member 16 assembled (e.g., attached, engaged, etc.) together from separate components. In another implementation, the main beam 12 may comprise a singly formed piece that includes the stock member 14 and the barrel member 16. In one implementation, a handgrip 18 may be mounted (e.g., attached) to the main beam 12, or may be formed as part of the main beam 12 and/or the stock member 14. A handgrip 18 may be mounted to the main beam 12 in any conventional manner chosen with sound judgment by a person of ordinary skill in the art. A trigger mechanism 20 suitable for shooting an arrow may be mounted to the main beam 12 in any suitable manner. It should be noted that the crossbow 10 may comprise any trigger mechanism chosen with sound judgment by a person of ordinary skill in the art. The crossbow 10 may also includes a bow assembly 30 adapted to propel an arrow and having a bow 32 and a bowstring 34. The bow 32 includes a pair of limbs 36, 36 that receive the bowstring 34 in any conventional manner chosen with sound judgment by a person of ordinary skill in the art. In one implementation, the bow 32 may comprise two to four limbs 36*a*, 36*b*, 36*c*, 36*d* that can be configured to receive the bowstring 34 in any suitable manner chosen with sound judgment by a person of ordinary skill in the art. In some implementations, a pair of wheels, cams, and/or pulleys 38*a*, 38*b* can be mounted to the limbs 36 to receive the bowstring 34 in a suitable manner. The crossbow 10 can comprises a riser 40, comprising at least a pair of limb pockets 42*a*, 42*b*. The limb pockets 42*a*, 42*b* may be attached (e.g., mechanically bolted) to the riser 40, and can be configured to receive an end of the limbs 36, for example, and the limbs may be secured therein (e.g., mechanically).

In one aspect, other crossbow components may be optionally used with (e.g., optionally attached, detached from) a crossbow using the subject matter described herein. As one example, the crossbow 10 may comprise a scope 50, which can be selectively attached to a scope mount 52, comprised on the main beam 12. Further, for example, one or more swivel studs 54 (see FIG. 2) may be disposed on the crossbow 10, for attaching an optional carry strap (not shown). Other optional components may include a cocking unit 56, for cocking the bowstring 34, and an arrow retention spring 58, used to hold an arrow on the barrel 16, for example.

Figure 2:
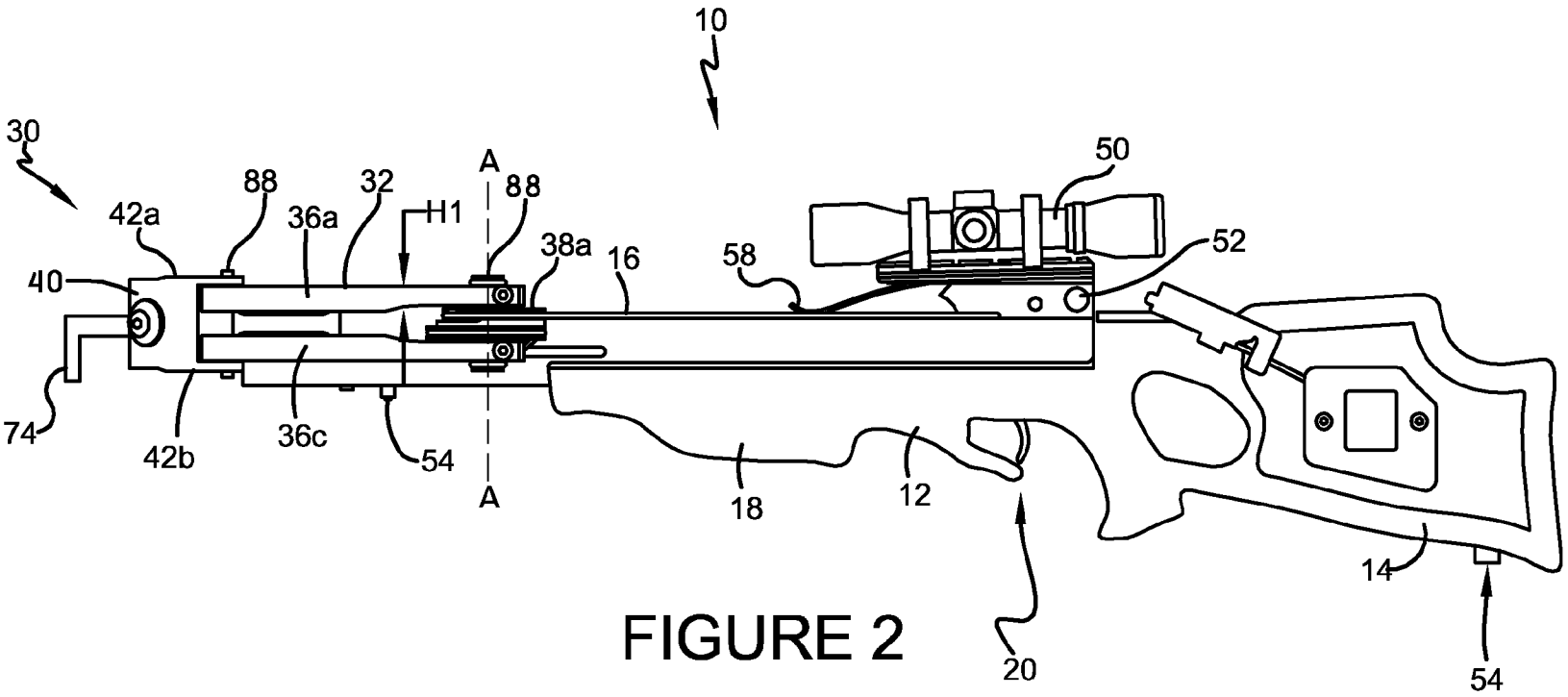
FIG. 2 is a component diagram illustrating a side view of an example implementation of a crossbow.
Figure 3:
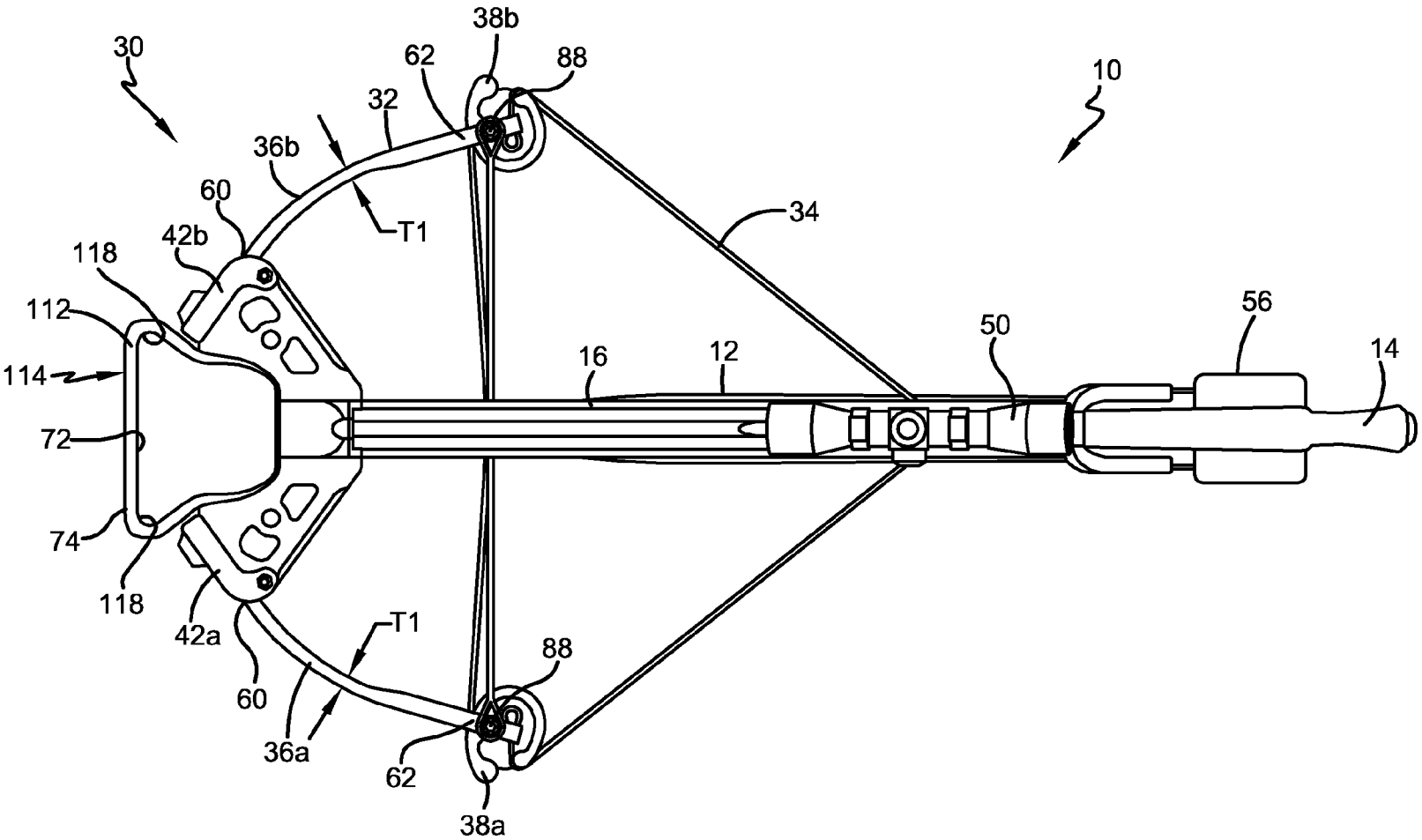
FIG. 3 is a component diagram illustrating a top view of an example implementation of a crossbow.
Figure 4:
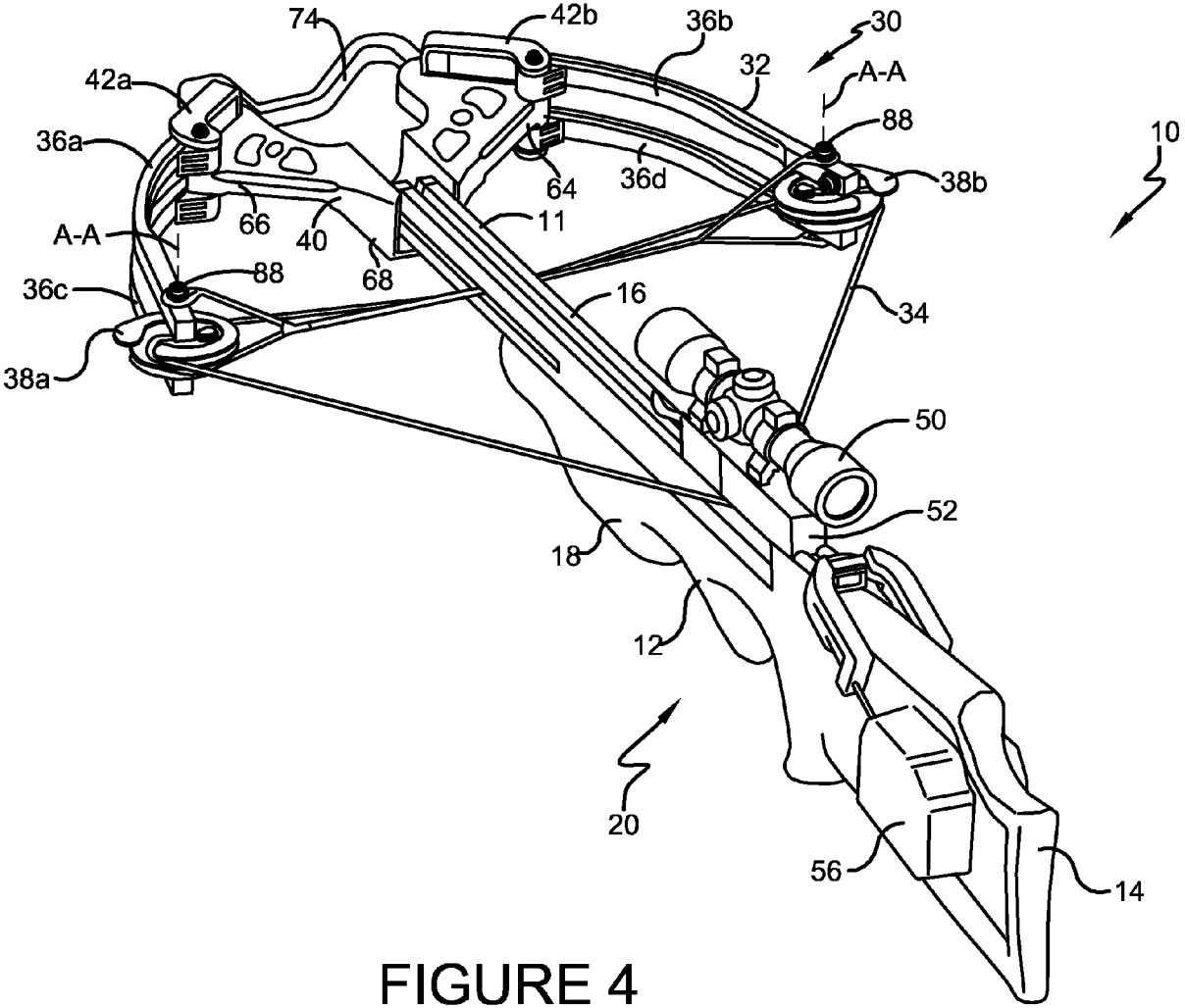
FIG. 4 is a component diagram illustrating a perspective end view of an example implementation of a crossbow.

FIG. 1 illustrates the crossbow 10 in an uncocked condition, while FIGS. 2-4 illustrate the crossbow 10 in a cocked condition.

In FIGS. 1-6, an implementation of a limb design is illustrated. In this implementation, respective limbs 36 comprise a first end 60, which may be received within a corresponding pocket 42, and a second end 62, which can be operatively connected to the bowstring 34. Further, respective limbs 36 may (as in FIG. 6) comprise a length L1, a height H1 (measured from bottom to top when the crossbow is held in the normal operating position), and a thickness T1. Additionally, respective limbs 36 can comprise a hinge point HP, which may be the point along the length L1 comprising a minimal thickness T1. It should be noted that the thickness T1 of a limb 36, according to one implementation, can vary continuously along its length L1 from the first end 60 to the hinge point HP. The position of the hinge point HP with respect to the first end 60 of the limb 36 can be any suitable position chosen with sound judgment by a person of ordinary skill in the art.

With continued reference now to FIGS. 1-6, in certain implementations and without limitation, respective limbs 36 may comprise a carbon fiber composite material. As one example, the carbon fiber composite material may provide respective limbs 36, and therefore the crossbow 10, with a reduced weight. In one implementation, the carbon fiber composite material limb 36 may comprise a reduced weight relative to alternate limbs, for example, thereby resulting in a lighter weight crossbow. As one example, the carbon fiber composite material limb 36 may cause a greater attenuation of sound and vibration when shooting the crossbow 10.

In one implementation, respective carbon fiber composite material limbs 36 may be pre-engineered and may comprise, at least partially, actual carbon fibers. Further, respective carbon fiber composite material limbs 36 may comprise a decorative design applied thereon. In one implementation, the decorative design may comprise a camouflage pattern that, at least partially, provides a camouflaged appearance to the crossbow 10 that may increase the user's ability to remain undetected while hunting game. In one implementation, the decorative design may comprise an epoxy outer layer that can be applied over respective carbon fiber composite material limbs 36, such as during the manufacturing of the limbs 36 and/or the crossbow 10. In another implementation, the decorative design may be applied onto the limbs 36 using other methods known in the art.

Figure 5:
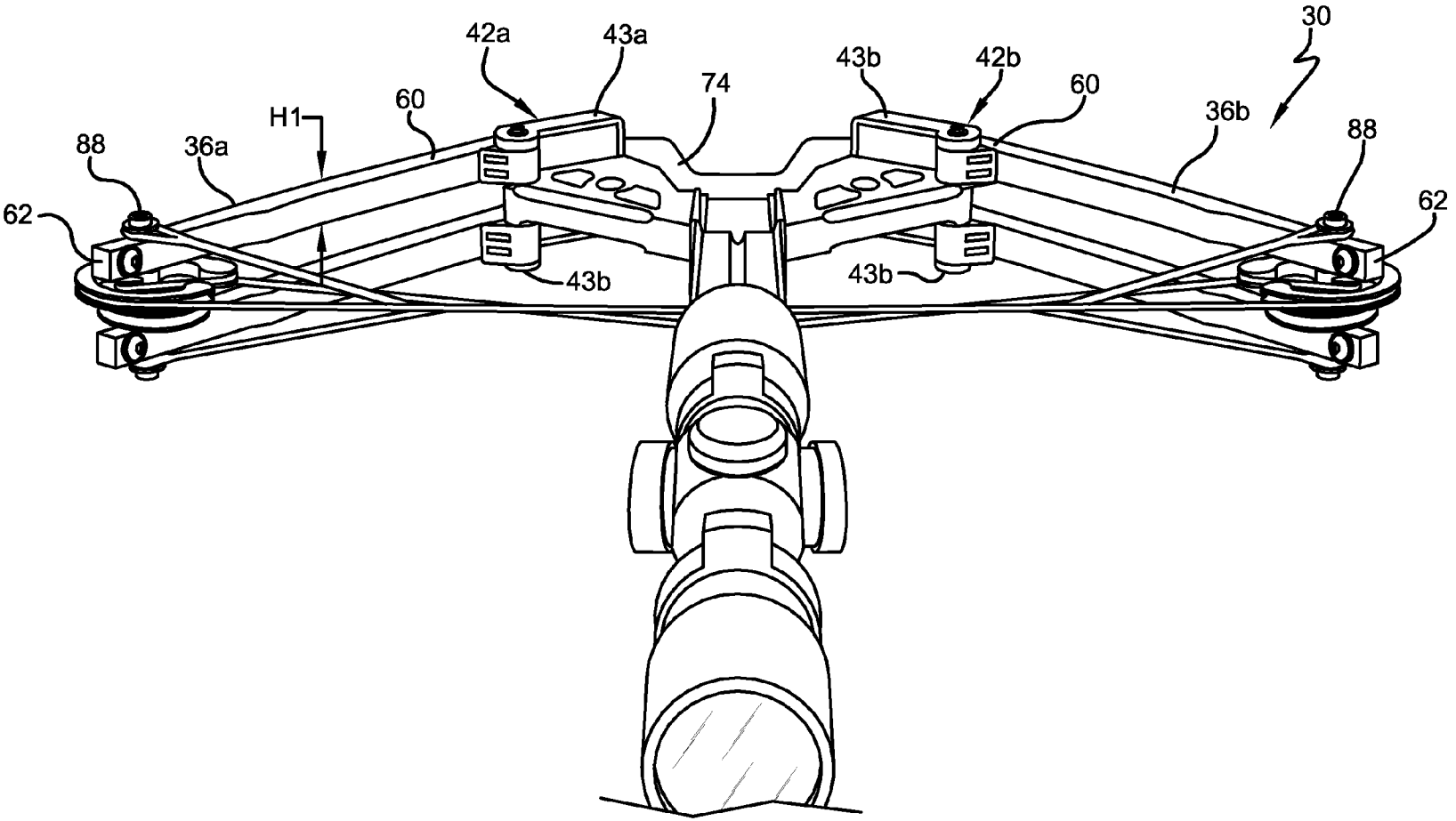
FIG. 5 is a component diagram illustrating a perspective end view of a portion of an example implementation of a crossbow.
Figure 6:
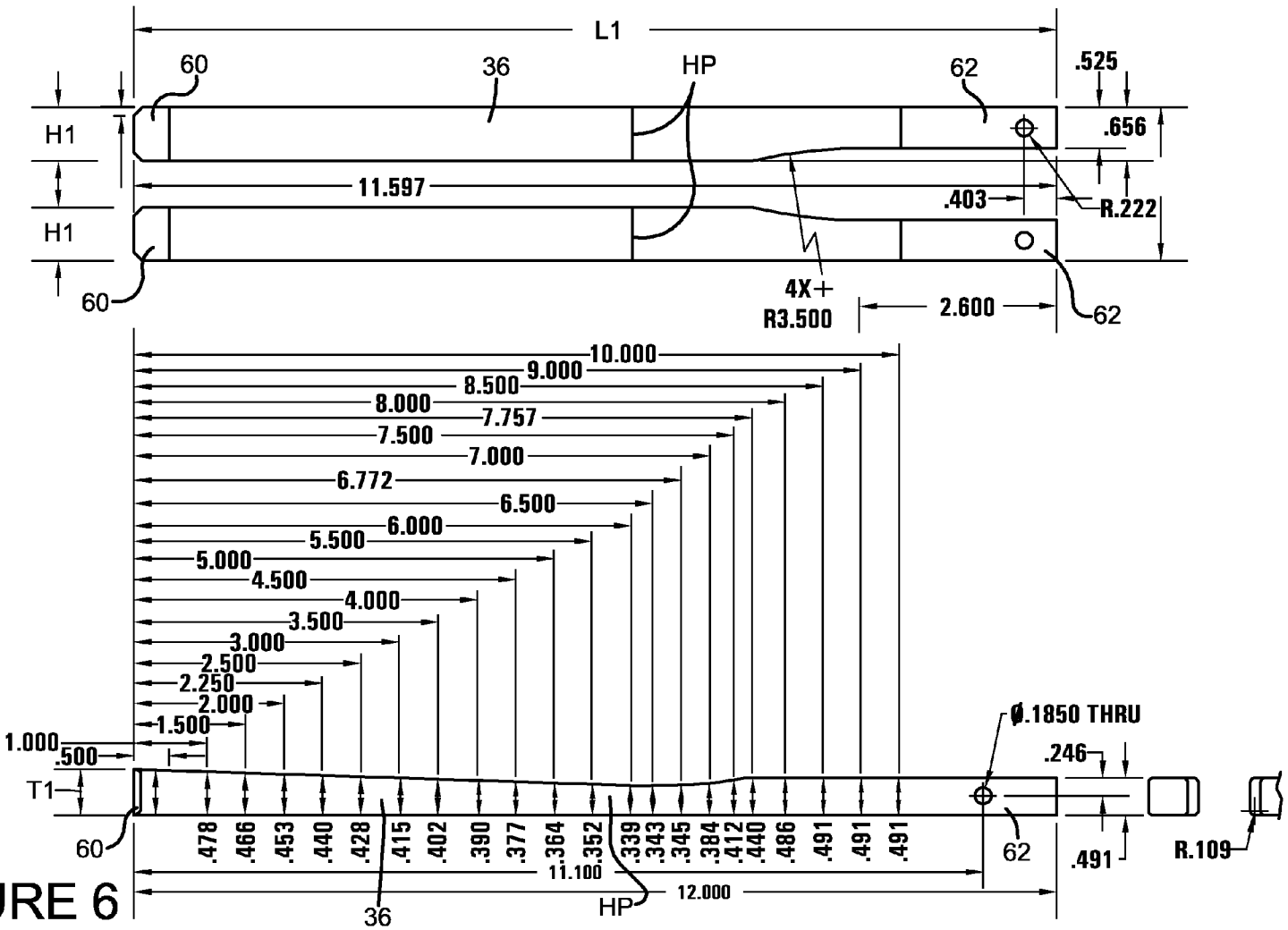
FIG. 6 illustrates example limb dimensions according to one implementation of a crossbow.
Figure 7:
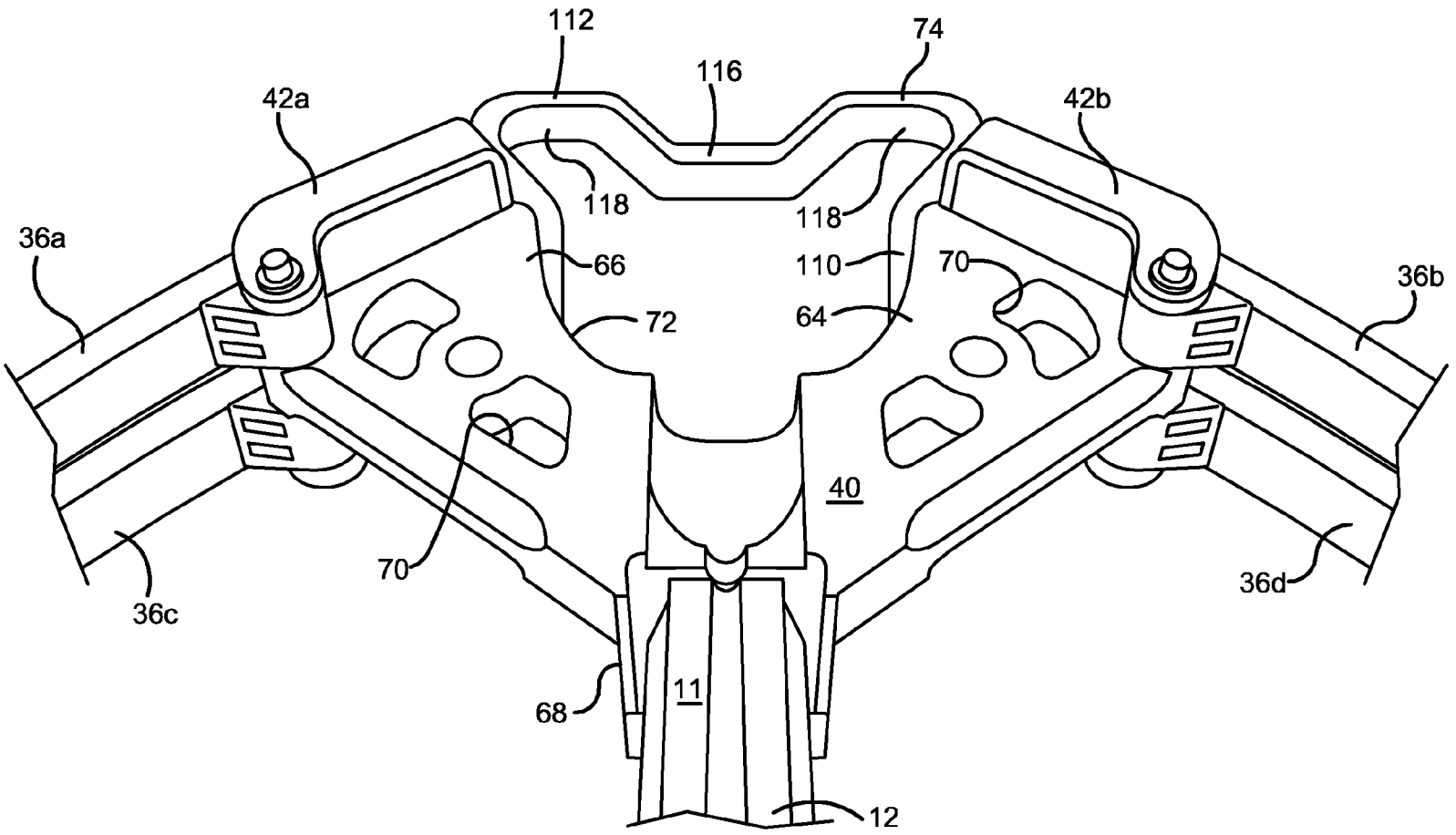
FIG. 7 is a component diagram illustrating a close-up top perspective view of an example implementation of one or more portions of a crossbow.

With reference now to FIGS. 2 and 5, in certain implementations and without limitation, respective pockets 42*a*, 42*b* may have first and second portions 43*a*, 43*b*. In one implementation, the first portion 43*a* of the first pocket 42*a* can receive separate limbs 36*a*, 36*c*, and the second portion 43*b* of the second pocket 42*b* can receive separate limbs 36*b*, 36*d*. In this way, for example, the crossbow 10 may use dual limbs on each end of the riser 40. It should be noted that the limb designs described herein may not only be applicable to a crossbow but can also apply to a compound bow or other bows when applied with sound judgment by a person of ordinary skill in the art.

With reference now to FIGS. 1-4 and 7-12, one or more implementations of a riser may be described. In one implementation, the riser 40 may comprise a first end 64 comprising a first pocket 42*a* and a second end 66 comprising a second pocket 42*b*. Further, the riser 40 may include a connection portion 68, which can be used for connecting the riser 40 to the first end 11 of the main beam 12. As one example, the connection portion 68 may be connected to the main beam 12 in any suitable manner chosen with sound judgment by a person of ordinary skill in the art, such as using bolts to mechanically fasten the components together.

In one implementation, the riser 40 may comprise one or more cutouts 70, 170, 270, for example, in order to mitigate an amount of riser material, while providing sufficient structural properties for the crossbow 10. In one implementation, the riser 40 may substantially completely comprise a carbon fiber composite material. As one example, the carbon fiber composite material may reduce the weight of the riser 40 and may provide the same or improved structural characteristics when compared with alternate materials. In this way, for example, the weight of the crossbow 10 may be reduced while the characteristics of the crossbow 10 remain the same, or may be improved. Further, as an example, the carbon fiber composite material of the riser 40 may cause a greater attenuation of sound and vibration when shooting with the crossbow 10.

In one implementation, the carbon fiber composite material riser 40 may be pre-engineered and/or may comprise, at least partially, carbon fibers. In one implementation, the carbon fiber composite material riser 40 may include a decorative design applied thereon. As one example, the decorative design may comprise a camouflage pattern that, at least, partially provides a camouflaged appearance to the crossbow 10, which may increase the user's ability to remain undetected while hunting. In one implementation, the decorative design may comprise an epoxy outer layer that can be applied over the carbon fiber composite material riser 40, for example, during the manufacturing of the riser 40 and/or crossbow 10. In another implementation, the decorative design may be applied onto the carbon fiber composite material riser 40 using other methods known in the art.

In one aspect (e.g., referring to FIGS. 21 and 22), the riser of a crossbow may be ultra-light. In one implementation, an ultra-light riser (e.g., 140, 240) may comprise a material that is strong, stiff, and/or light-weight. As one example, an ultra-light riser (e.g., 140, 240), comprising a material that is strong and/or stiff, may be strong enough and/or stiff enough to acceptably withstand expected operational loads to which it will be subject, while comprising a geometry that makes the riser especially light when compared to alternate risers. In one implementation, the geometry of an ultra-light riser (e.g., 140, 240) may comprise open areas 170, 270, such as through holes, for example, that may create a reduced bulk density when compared to alternate risers. The "bulk density" of an object (e.g., or group of objects) can refer to the density of the overall object (e.g., or group of objects) calculated as the ratio of the mass of the material of the object(s) to the sum of the volume of the material of the object(s) and the volume of open areas 170, 270 (e.g., through holes) of the object(s).

Figure 21:
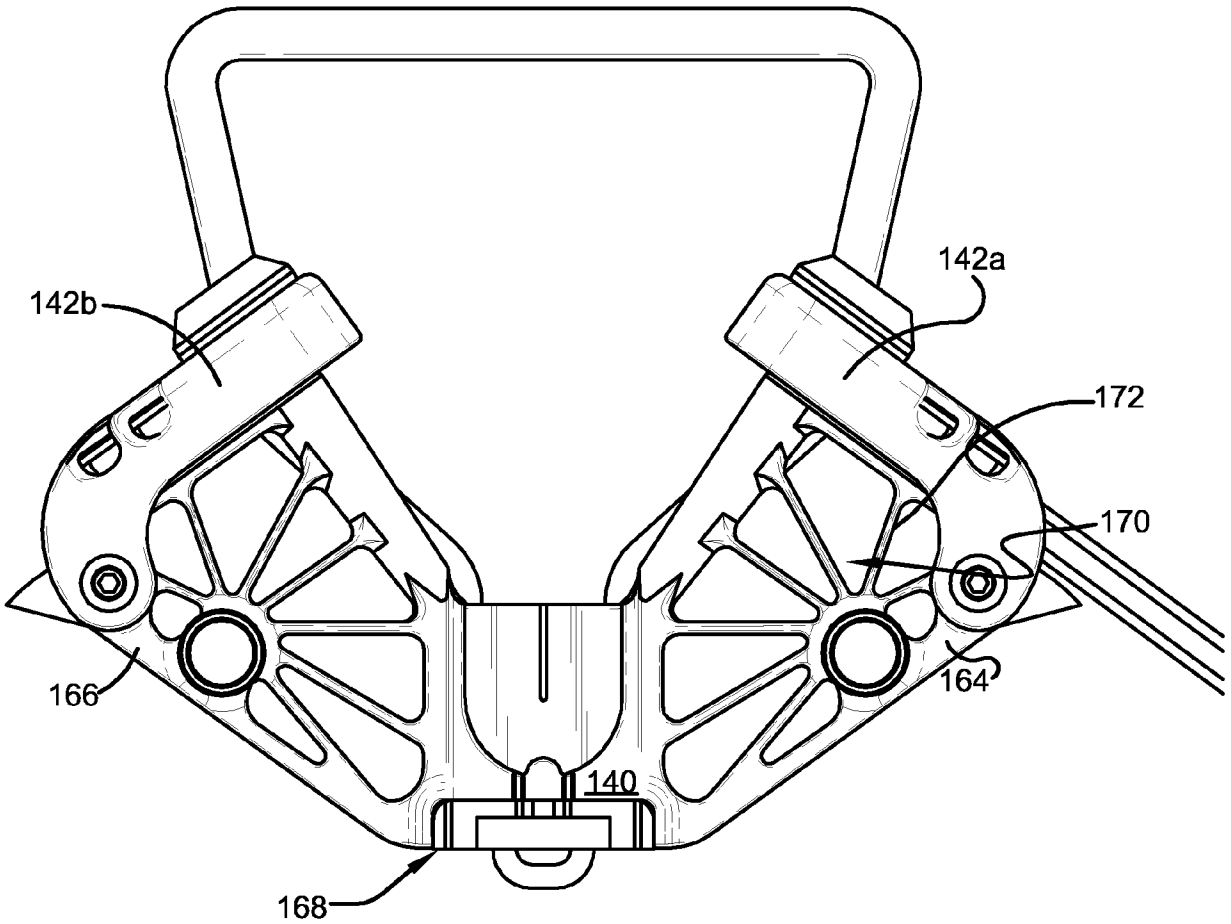
FIG. 21 is a component diagram illustrating a top view of an example implementation of one or more portions of a crossbow.

FIG. 21 is a component diagram illustrating a top view of an example implementation of one or more portions of a crossbow. In this implementation, a partial assembly of a crossbow comprises a riser 140 (e.g., an ultra-light riser). The riser 140 may comprise a material that is strong, stiff, and/or light-weight, such as a carbon fiber composite material, an aluminum-based material, and/or a titanium-based material. In this implementation, the riser 140 comprises a first end 164, comprising a first limb holder 142 (e.g., pocket) and a second end 166 with a second limb holder 142. The riser 140 can further comprise a connection portion 168, for example, which may be used to connect the riser 140 to the first end 11 of the main beam 12. As with alternate risers, the connection portion 168 may be connected to the main beam 12 in any suitable manner chosen with sound judgment by a person of ordinary skill in the art, such as, for example, using bolts.

In this implementation, the riser 140 comprises through holes 170 (e.g., cutouts). The respective through holes 170 can be bounded by (e.g., and defined by) a wall 172. As one example, the through holes 170 can reduce an amount of material used to form the riser 140, thereby reducing the weight of the riser. As an example, a through hole 170 may be referred to as a cell and/or a cutout; that is, a cell can comprise an open region of the riser 140. In an ultra-light riser (e.g., 140), the material properties of the material used to form the riser may permit the riser to be made with much larger cells than alternate risers. In this way, for example, the ultra-light riser may comprise a low bulk density (e.g., and is light-weight), while being strong enough and stiff enough to acceptably withstand expected operational loads to which the riser may be subjected.

Figure 22:
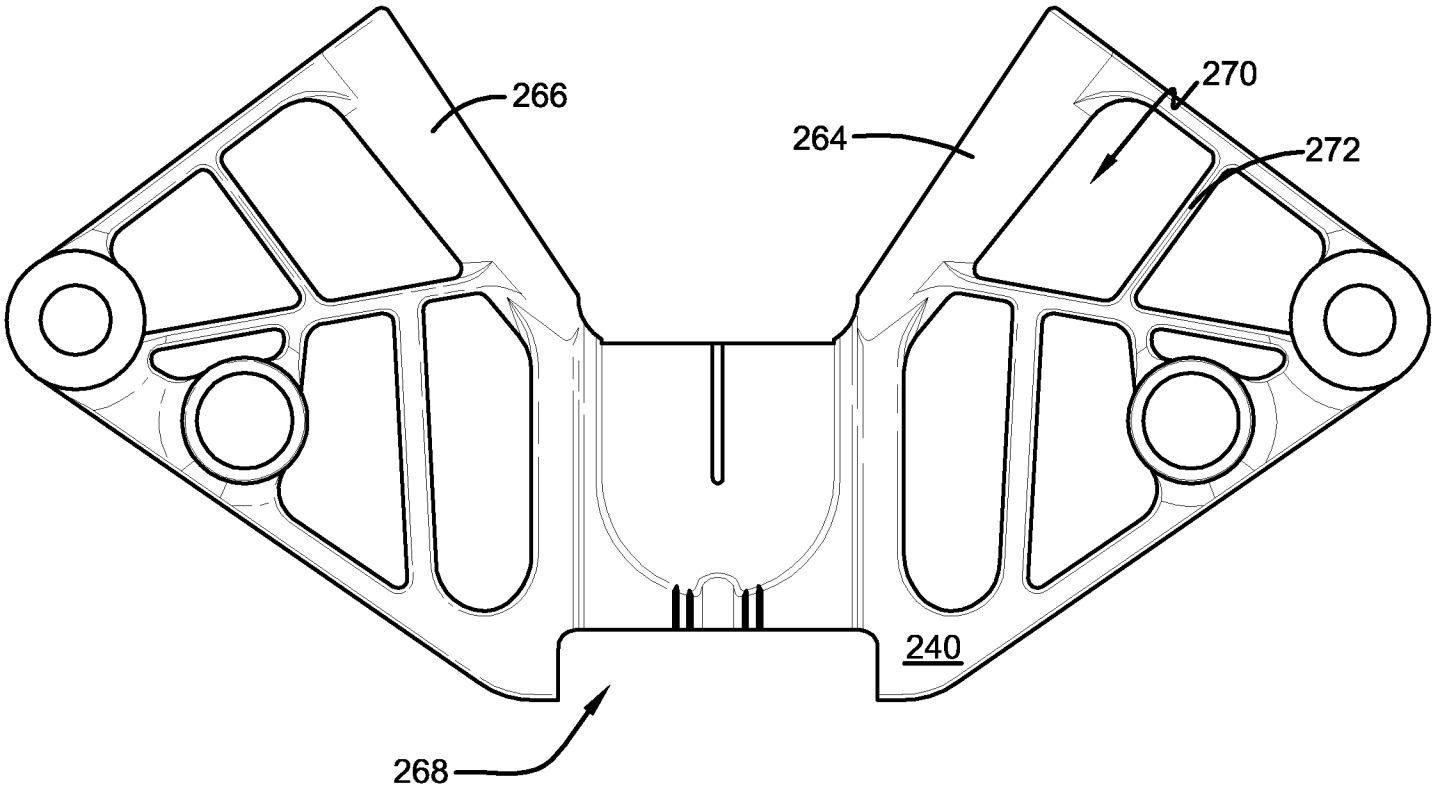
FIG. 22 is a component diagram illustrating a top view of an example implementation of one or more portions of a crossbow.

FIG. 22 is a component diagram illustrating a top view of an example implementation of one or more portions of a crossbow. In this implementation, an alternate riser 240 (e.g., ultra-light) is illustrated. In this implementation, the riser 240 may comprise a material that is strong, stiff, and/or light-weight, such as a carbon fiber composite material, an aluminum-based material, and/or a titanium-based material. Further, the riser 240 comprises a first end 264 a second end 266. The riser 240 may also include a connection portion 268, which can be used to connect the riser 240 to the first end 11 of the main beam 12. As with conventional risers, the connection portion 268 may be connected to the main beam 12 in any suitable manner chosen with sound judgment by a person of ordinary skill in the art, such as using bolts.

In this implementation, the riser 240 comprises through holes 270 (e.g., cutouts). The respective through holes 270 can be bounded by (e.g., and defined by) a wall 272. As one example, the through holes 270 can reduce an amount of material used to form the riser 240, thereby reducing the weight of the riser. As an example, a through hole 270 may be referred to as a cell and/or a cutout; that is, a cell can comprise an open region of the riser 240. In an ultra-light riser (e.g., 240), the material properties of the material used to form the riser may permit the riser to be made with much larger cells than alternate risers. In this way, for example, the ultra-light riser may comprise a low bulk density (e.g., and is lightweight), while being strong enough and stiff enough to acceptably withstand expected operational loads to which the riser may be subjected.

In one aspect, the geometry of the risers 140, 240 in FIGS. 21 and 22, and/or the means for reducing the weight of the risers 140, 240, may be characterized in alternate ways. In one implementation, the volume of all or parts of the risers 140, 240 may be used to describe their characteristics. In this implementation, the ratio of the volume of the cells 170, 270 of the riser 140, 240 to the volume of the walls 172, 272 of riser 140, 240 may be greater than 2.0, greater than 3.0, greater than 4.0, greater than 5.0, and/or greater than 6.0. That is, for example, the volume of the cell(s) (e.g., empty space of the riser) can be six times greater (or more) than the volume of the walls (e.g., comprising the strong, stiff, and/or lightweight material).

In another implementation, a cross-sectional area may be used to characterize the geometry of the riser 140, 240. As one example, a representative cross-section of the riser 140, 240 may be defined by a sectional plane that is parallel to the top surface of the riser 140, 240. Notwithstanding a slight fillet radius around the top and bottom perimeter of a cell, the area of the cells 170, 270 in the representative cross-section of the riser 140, 240 may be substantially constant with depth. Similarly, the area of the walls 172, 272 in the representative cross-section of the riser 140, 240 is substantially constant with depth. In this implementation, the ratio of the area of the cells 170, 270 to the area of the walls 172, 272 (e.g., measured on the sectional plane) may be greater than 2.0, greater than 3.0, greater than 4.0, greater than 5.0, and/or greater than 6.0. That is, for example, the area of the cell(s) covering a sectional plane of the riser can be six times greater (or more) than the area of the walls covering the sectional plane of the riser.

In another implementation, bulk density may be used to characterize the geometry of the riser 140, 240. As noted above, "bulk density" can refer to the density of the overall riser calculated as the ratio of the mass of the material of the riser to the sum of the volume of the material of the riser and the volume of empty regions (e.g., through holes, cells) of the riser. As one example, the empty regions in the riser 140, 240 can comprise cells 170, 270, which may be defined by walls 172, 272 comprising the material forming the riser. Accordingly, in this implementation, the bulk density of the riser 140, 240 can comprise the total mass of the materials comprising the walls 172, 272 divided by the sum of the volume of the walls 172, 272 and the volume of the cells 170, 270. In one implementation, the bulk density of riser 140, 240 may be less than 4.5 g/cc, may be less than 2.3 g/cc, may be less than 1.5 g/cc, may be less than 1.2 g/cc, may be less than 0.9 g/cc, and/or may be less than 0.75 g/cc.

In one implementation, the riser 140, 240 may comprise a decorative design that can be applied thereon. In one implementation, the decorative design may comprise a camouflage pattern that, at least partially, provides a camouflaged appearance to the crossbow 10, for example, which may increases the user's ability to remain undetected while hunting game. In one implementation, the decorative design may comprise an epoxy outer layer that can be applied over the riser 140, 240 during the manufacturing of the riser and/or crossbow. In another implementation, the decorative design may be applied onto riser 140, 240 using alternate methods known in the art.

As used herein, the strength of a material can be measured by its yield tensile strength at 0.2% strain. As one example, a strong material may have a tensile strength greater than 400 MPa, greater than 600 MPa, and/or greater than 800 MPa. As used herein, the stiffness of a material can be measured by its tensile modulus. As one example, a stiff material may have a tensile modulus greater than 70 GPa, greater than 100 GPa, and/or greater than 130 GPa. As used herein, the lightweightiness of a material can be measured by its density. As one example, a light material may have a density less than 6.0 g/cc, less than 4.0 g/cc, and/or less than 2.0 g/cc. The ratio of the strength of a material to the density of the material can be described as the specific strength of the material. As one example, a material that may be strong and/or light may have a specific strength greater than 200 kN·m/kg, greater than 250 kN·m/kg, and/or greater than 280 kN·m/kg. The ratio of the stiffness of a material to the density of the material can be described as the specific stiffness of the material. As one example, a material that is stiff and/or light may have a specific stiffness greater than 20 MN·m/kg, greater than 25 MN·m/kg, and/or greater than 28 MN·m/kg.

There are a variety of materials that are strong, stiff, and/or light. The set of materials that are strong, stiff, and/or light can comprise, without limitation, certain titanium alloys, certain aluminum alloys, and/or certain composite materials, such as carbon-fiber composite materials. As one example, a first titanium alloy that may be strong, stiff, and/or light is Titanium Ti-10V-2Fe-3Al. The typical material properties of Titanium Ti-10V-2Fe-3Al are a density of approximately 4.65 g/cc, an elastic modulus of approximately 110 GPa, and a tensile strength of approximately 1240 MPa. Accordingly, Titanium Ti-10V-2Fe-3Al has a typical specific strength of approximately 267 kN·m/kg and a typical specific stiffness of approximately 23.7 MN·m/kg. As another example, a second titanium alloy that may be strong, stiff, and/or light is Titanium Beta III (Ti-11.5Mo-6Zr-4.5Sn; Grade 10). The typical material properties of Titanium Beta III are a density of approximately 5.06 g/cc, an elastic modulus of approximately 108 GPa, and a tensile strength of approximately 1180 MPa. Accordingly, Titanium Beta III has a typical specific strength of approximately 233 kN·m/kg and a typical specific stiffness of approximately 21.3 MN·m/kg.

With continued reference now to FIGS. 1-4 and 7-12, an opening 72 may be formed in the riser 40 and may define a foot stirrup 74 which may be used, as is well known, in cocking the crossbow 10. In one implementation, the opening 72 may be positioned, at least partially, directly between the pockets 42*a*, 42*b*. As one example, this arrangement can provide an opening 72 that may be sufficient to accommodate most boot sizes, yet may also provide a reduced overall length for the crossbow 10, thereby making it easier to manually cock the bowstring 34. In another implementation, the pockets 42*a*, 42*b* can extend at least partially longitudinally beyond the first end 11 of the main beam 12. This arrangement may also provide for an overall reduced length for the crossbow 10. In yet another implementation, the foot stirrup 74 can be made with the riser 40 as a single piece. As an example, this may permit the riser 40 and the foot stirrup 74 to be formed (e.g., machined) from a single piece of material.

Figure 8:
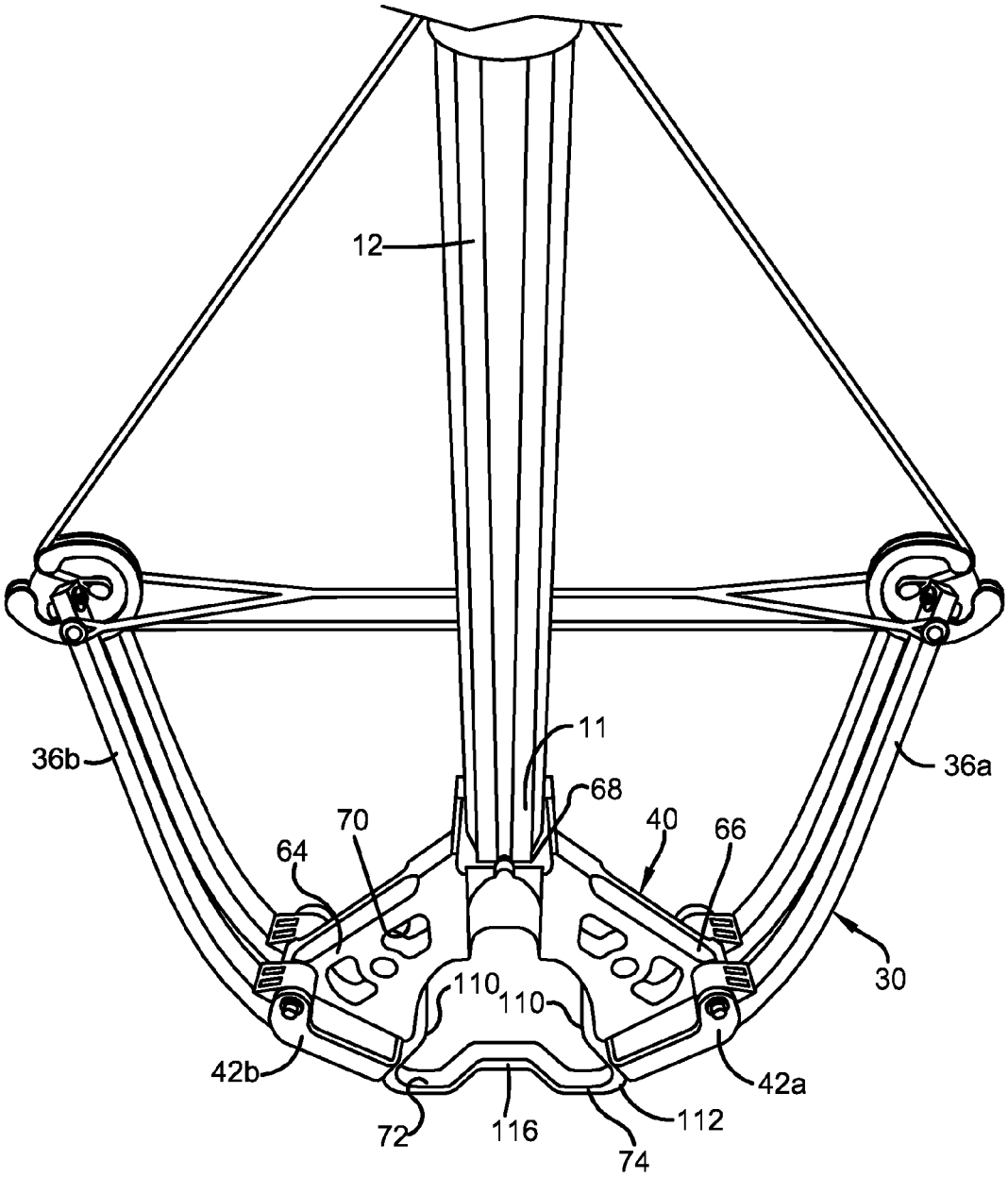
FIG. 8 is a component diagram illustrating a perspective view of an example implementation of one or more portions of a crossbow.
Figure 9:
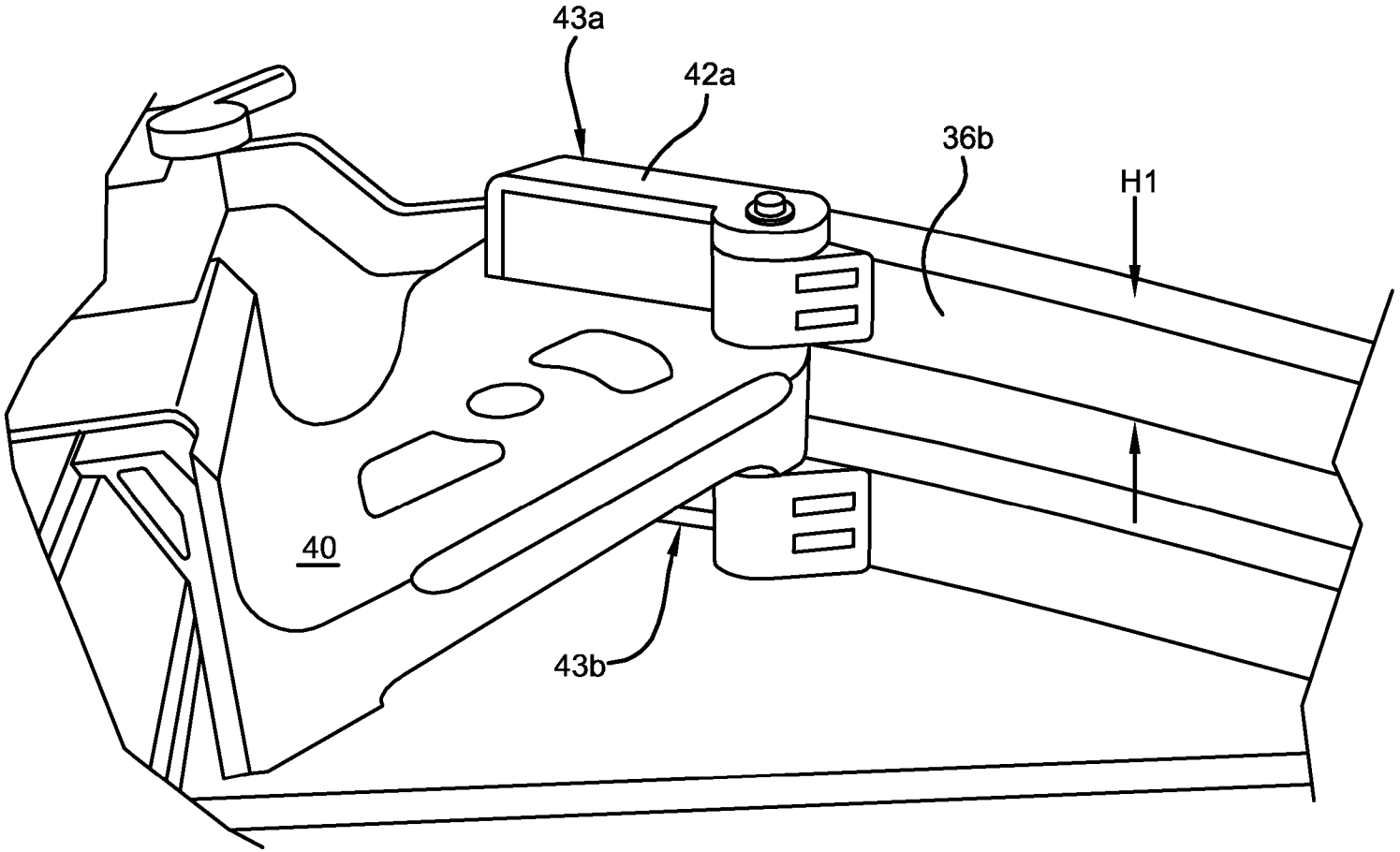
FIG. 9 is a component diagram illustrating a close-up top perspective view of an example implementation of one or more portions of a crossbow.
Figure 10:
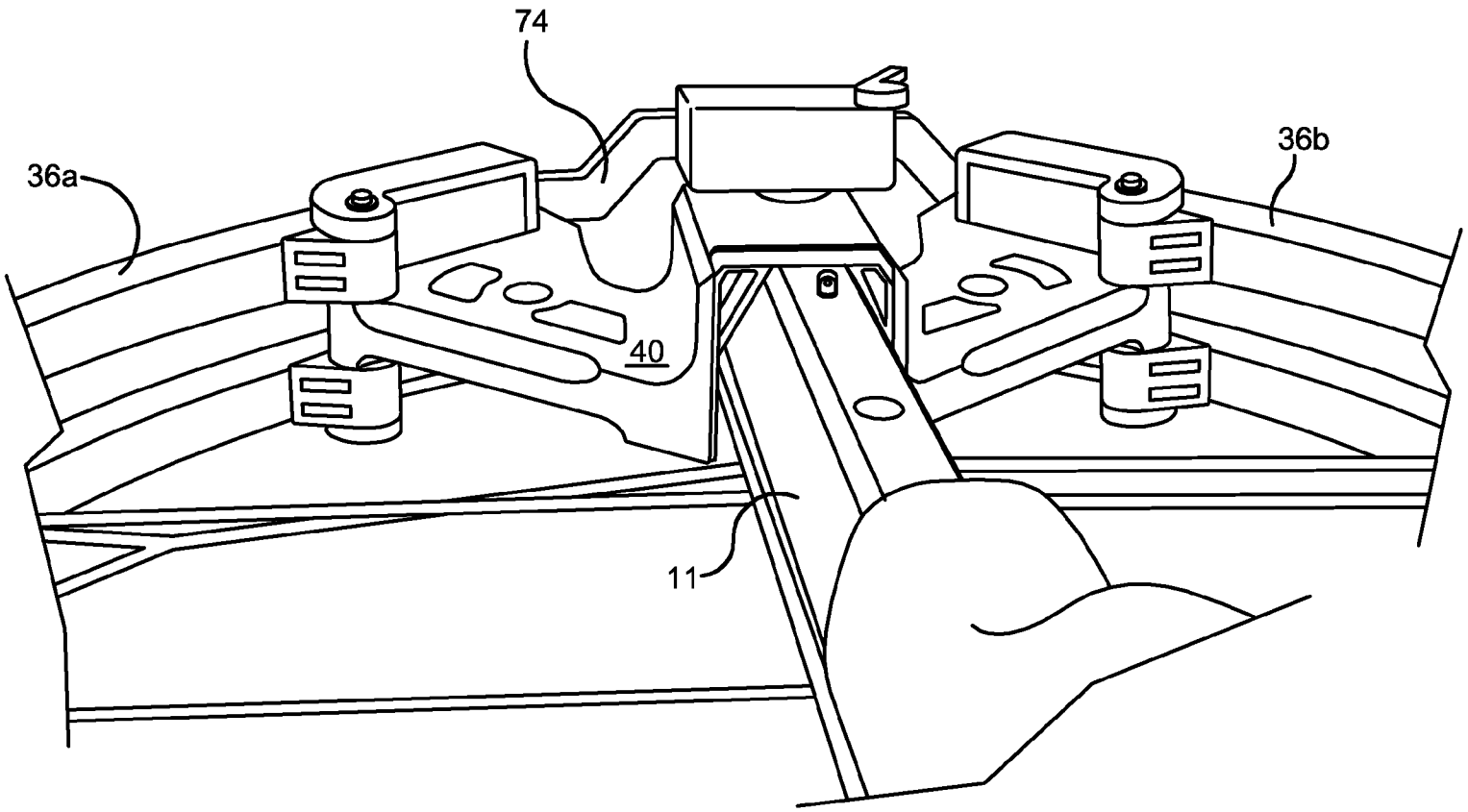
FIG. 10 is a component diagram illustrating a close-up top perspective view of an example implementation of one or more portions of a crossbow.
Figure 11:
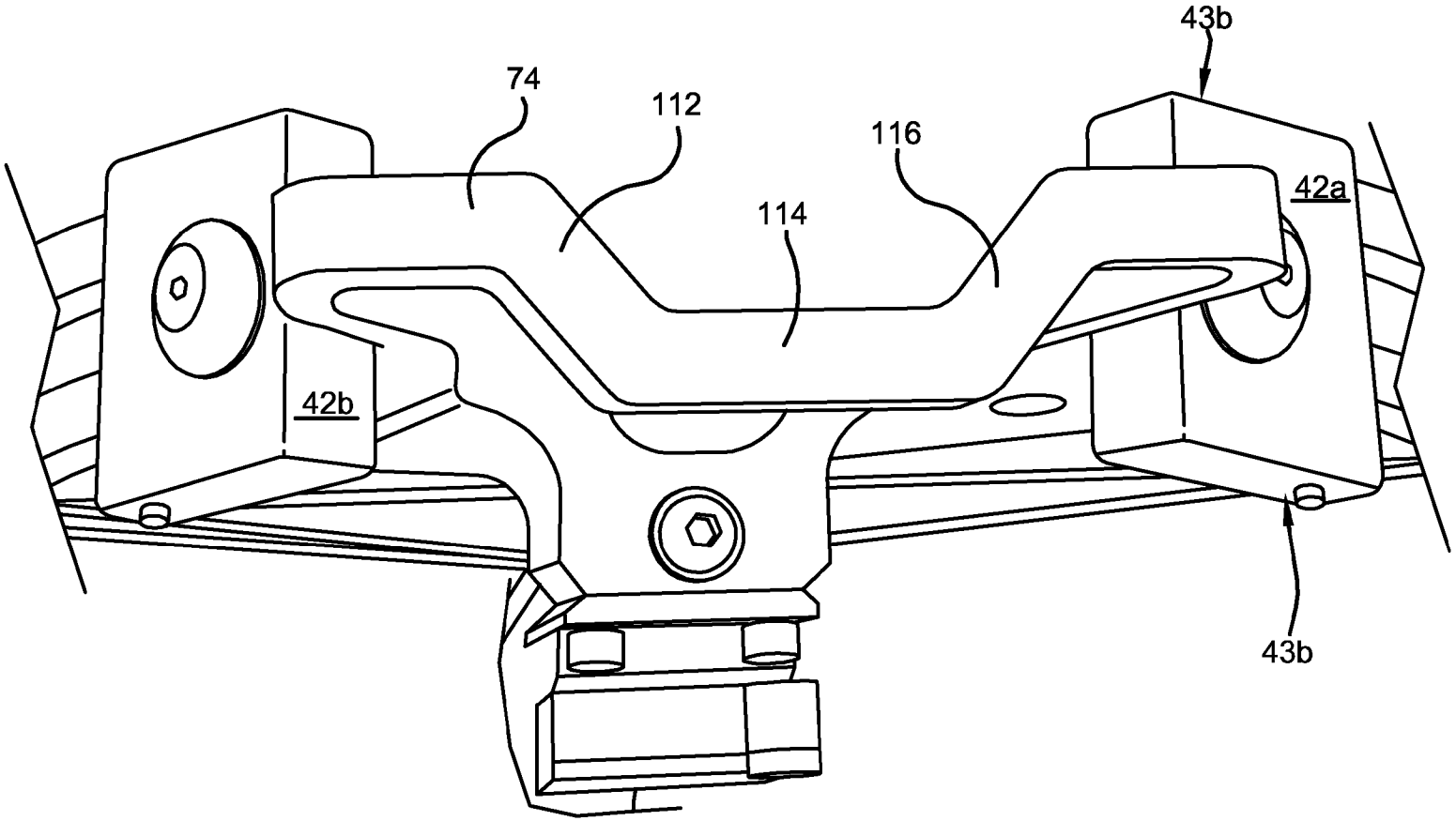
FIG. 11 is a component diagram illustrating a close-up end view of an example implementation of one or more portions of a crossbow.
Figure 12:
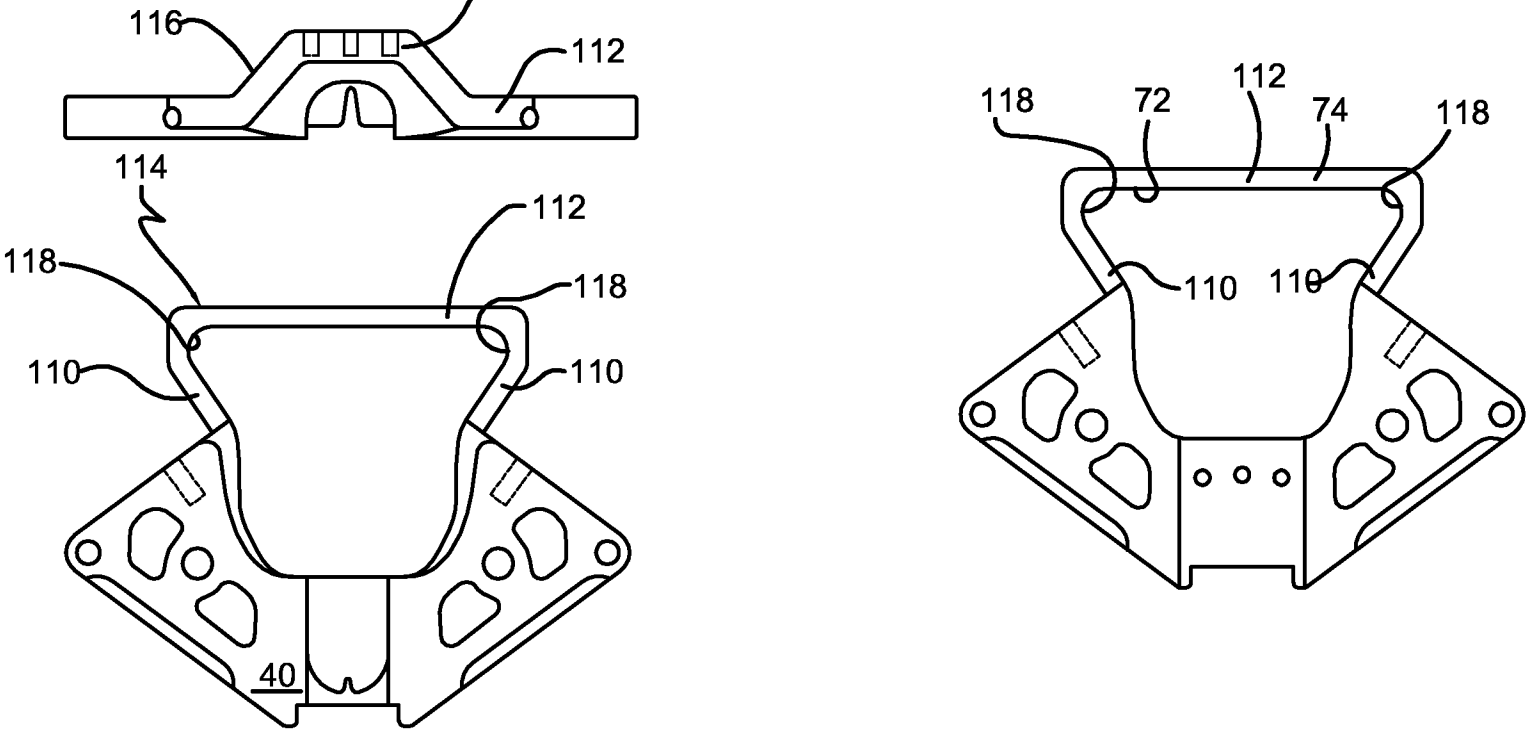
FIG. 12 is a component diagram illustrating of an example implementation of one or more portions of a crossbow.
Figure 13:
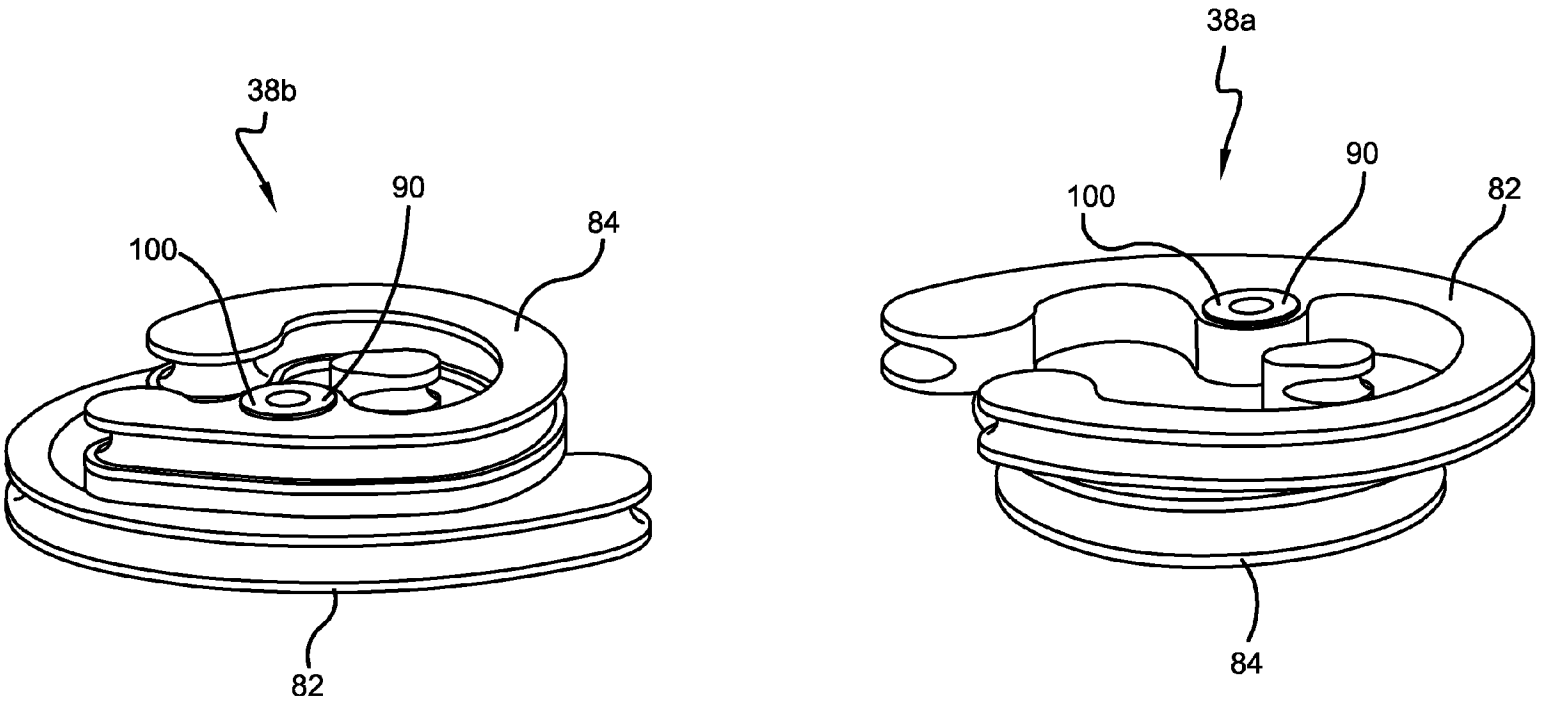
FIG. 13 is a component diagram illustrating a perspective side view of an example implementation of one or more portions of a crossbow.
Figure 14:
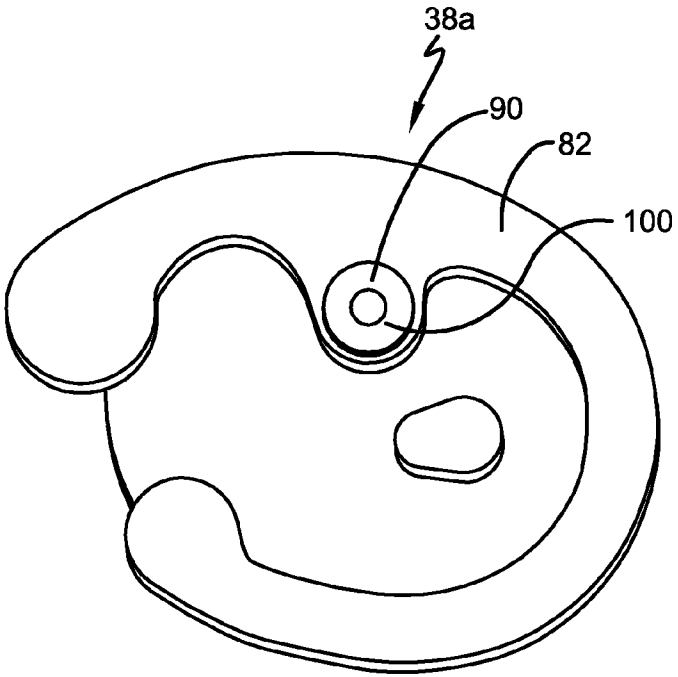
FIG. 14 is a component diagram illustrating a top view of one or more portions an of example implementation of a crossbow.
Figure 14:
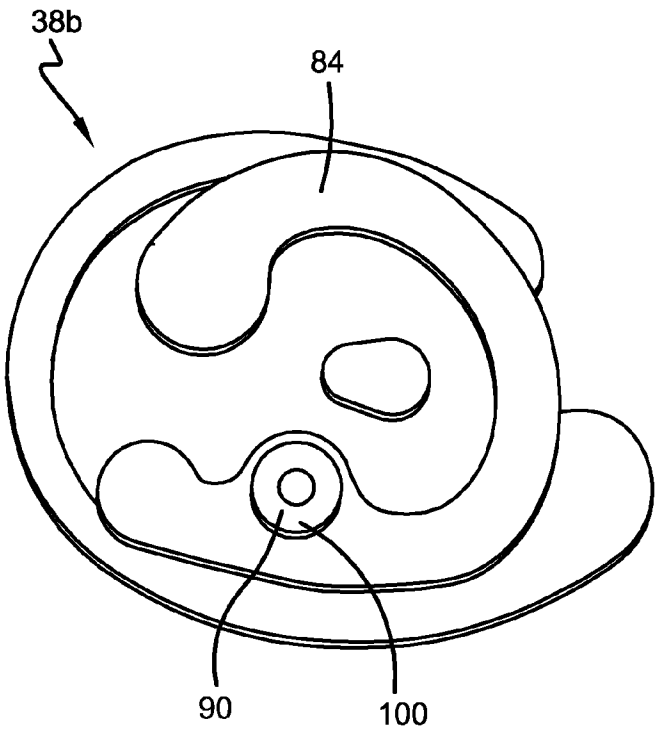
Figure 15:
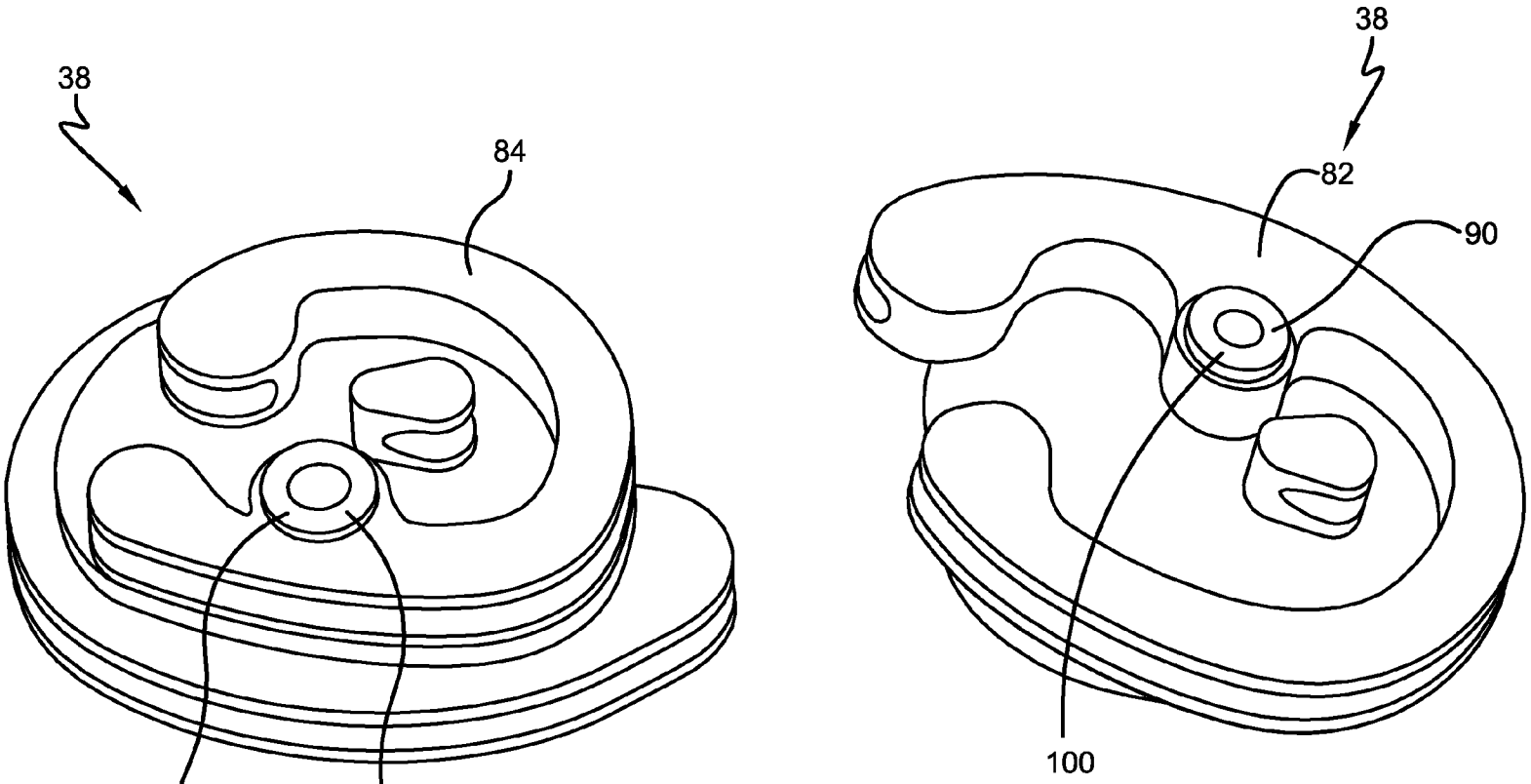
FIG. 15 is a component diagram illustrating a perspective top view of an example implementation of one or more portions of a crossbow.
Figure 16:
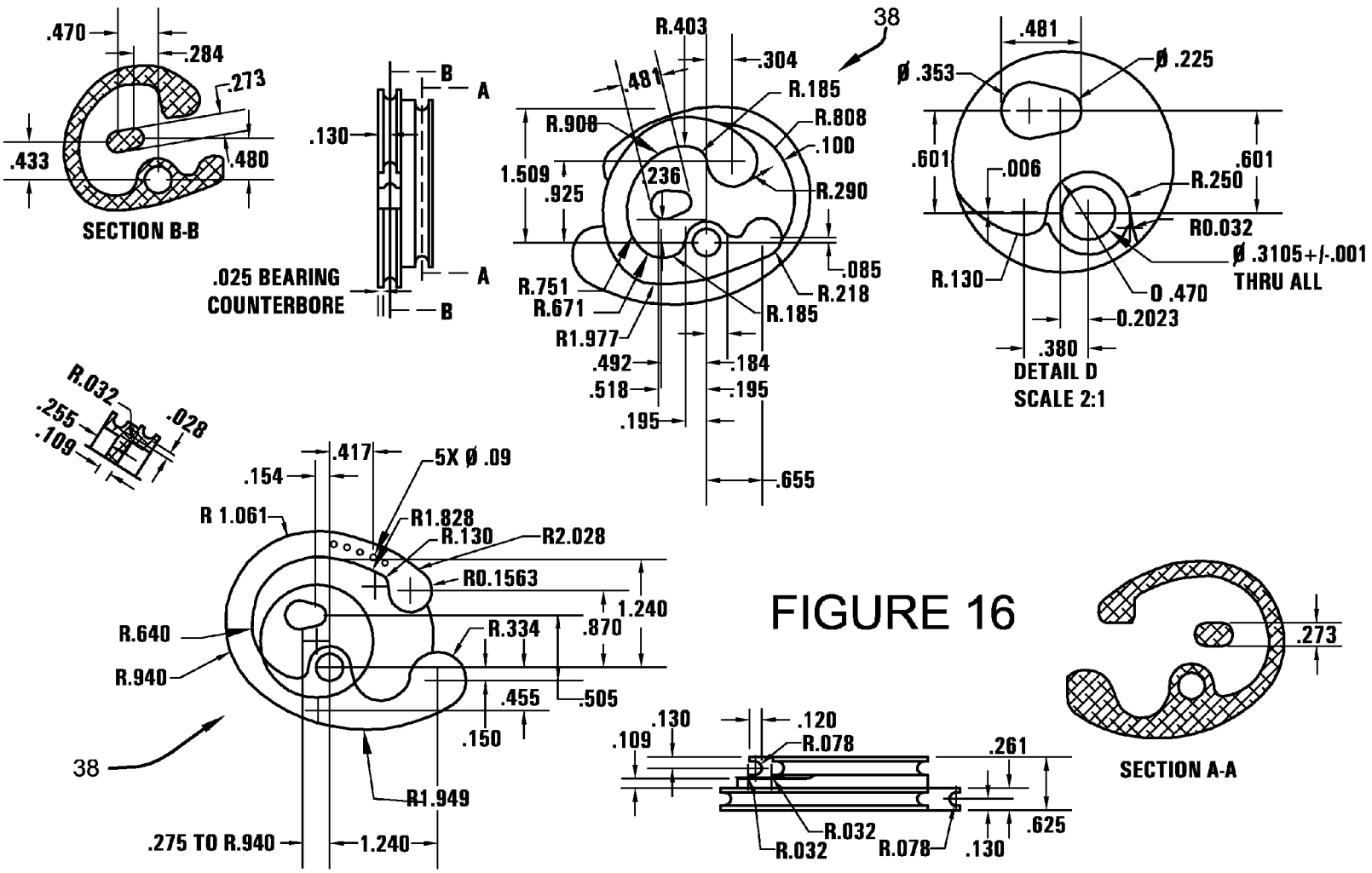
FIG. 16 is a component diagram illustrating an example implementation of one or more portions of a crossbow.
Figure 17:
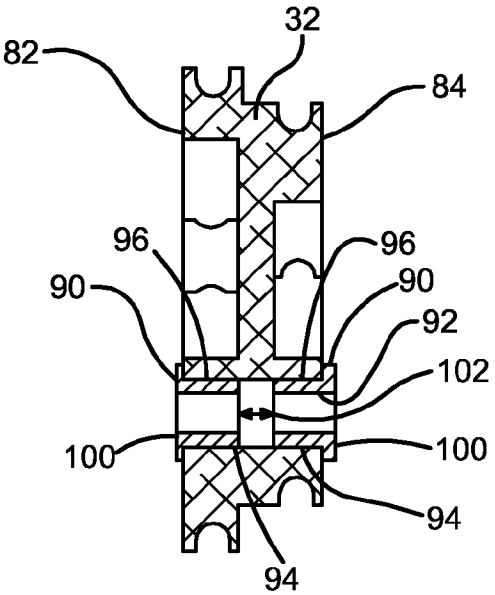
FIG. 17 is a component diagram illustrating an example implementation of one or more portions of a crossbow.
Figure 17:
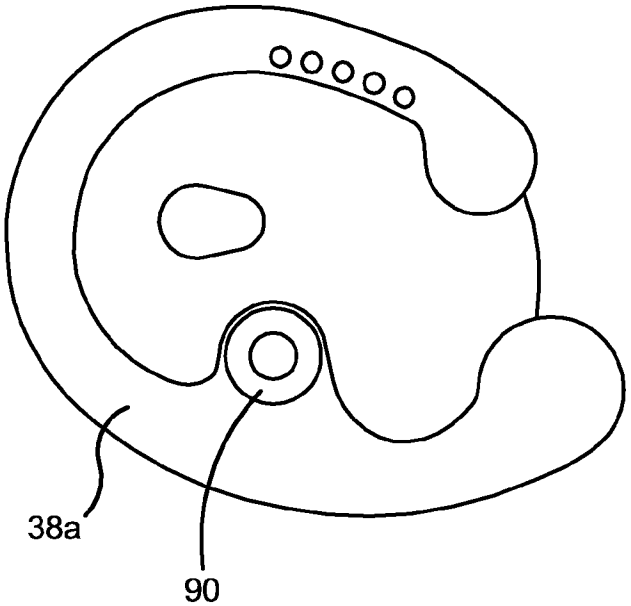
Figure 18:
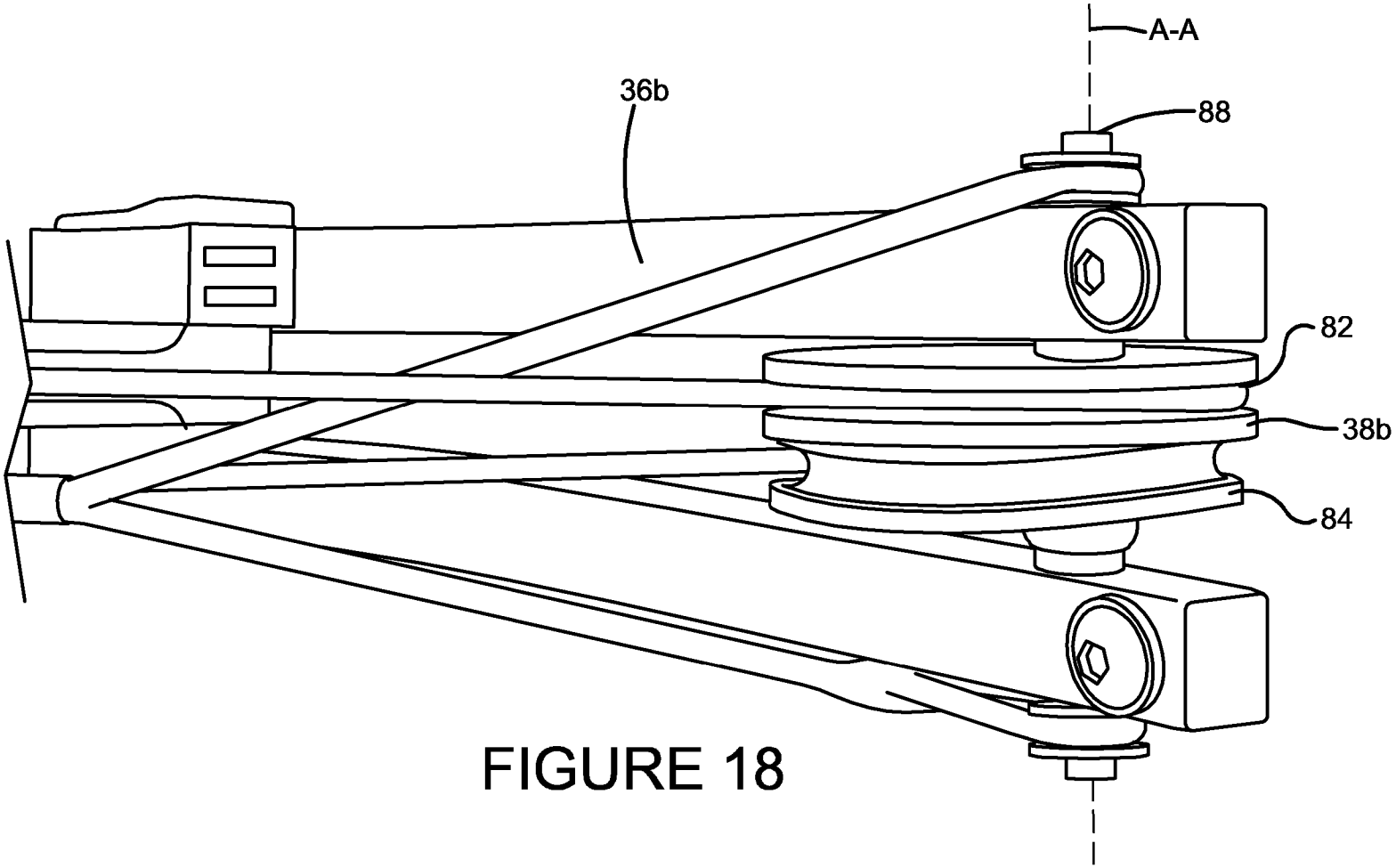
FIG. 18 is a component diagram illustrating a close-up perspective view of an example implementation of one or more portions of a crossbow.
Figure 19:
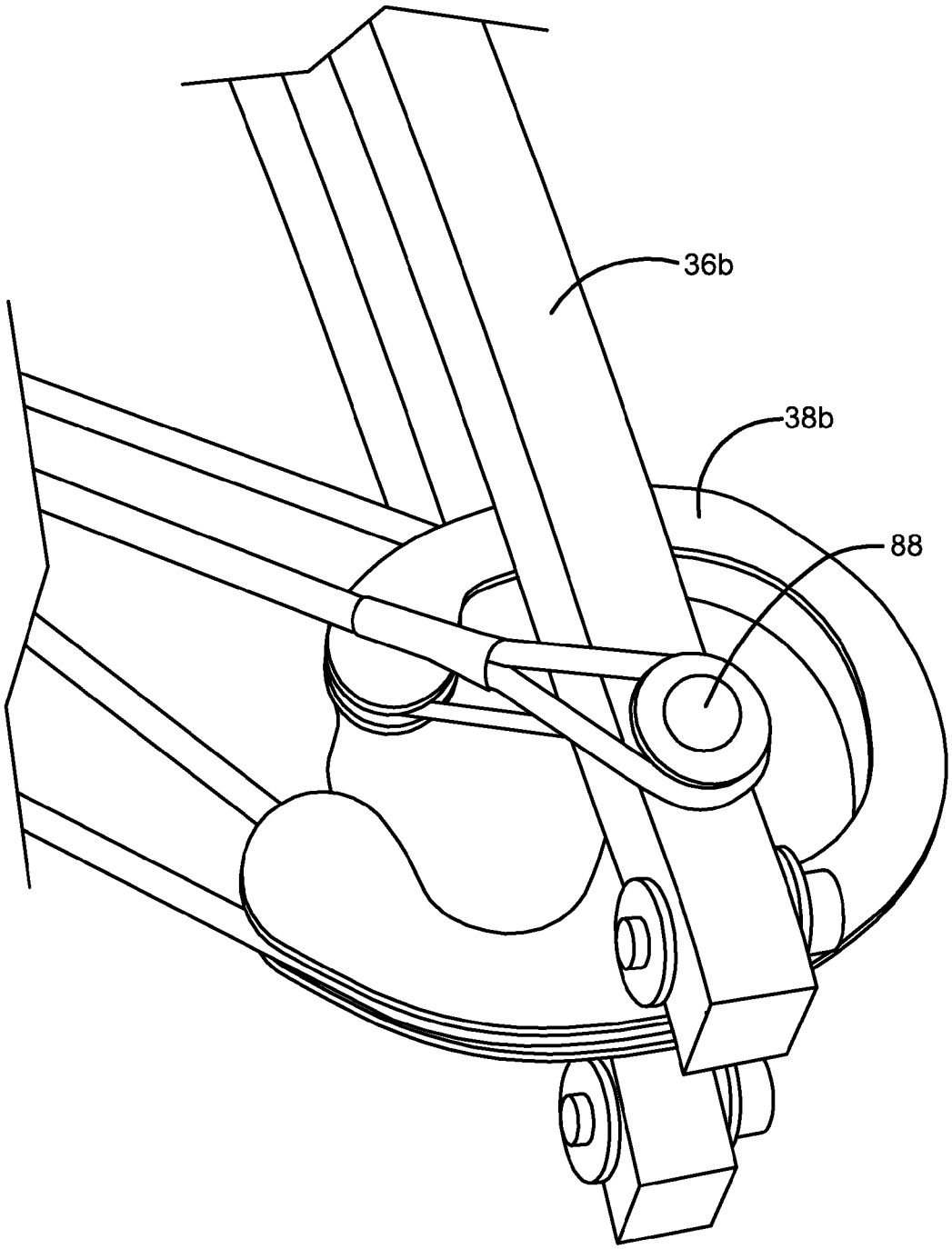
FIG. 19 is a component diagram illustrating a top view of an example implementation of one or more portions of a crossbow.
Figure 20:
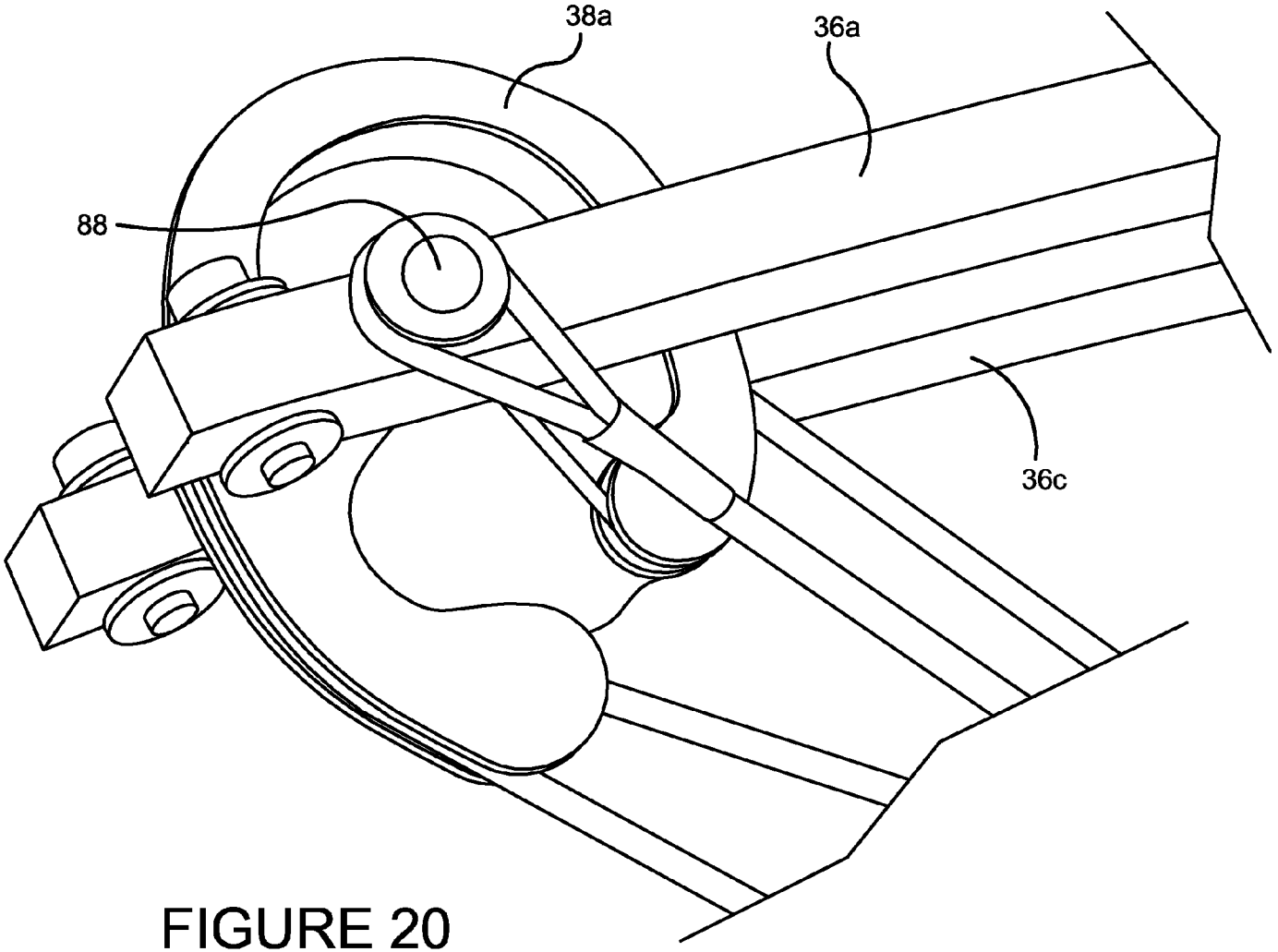
FIG. 20 is a component diagram illustrating a top view of an example implementation of one or more portions of a crossbow.

In one implementation, the foot stirrup 74 can comprise a generally U-shaped member extending from the riser body. In this implementation, the U-shaped member can comprise a pair of leg portions 110 and a mid-portion 112. The mid-portion 112 can comprise outer surface 114, for example, that is substantially planar and may be used in contacting a ground surface (as shown in FIG. 8) when cocking the crossbow 10. In one implementation, the mid-portion 112 may be planar to the leg portions 110. In another implementation (as shown), the mid-portion 112 can comprise an offset 116. As an example, this offset 116 may permit the crossbow 10 to be more easily balanced on a ground surface when a user is cocking the crossbow 10. As shown in FIGS. 11-12, the offset 116 may extend downwardly.

In one implementation, the leg portions 110 can extend substantially perpendicular from an inner surface of the mid-portion 112. In another implementation, shown in FIG. 12, respective leg portions 110 can comprise an offset 118 that may extend outwardly. As an example, this offset 118 may permit the opening 72 to be larger, thereby accommodating a user's foot that is larger, and may also provide for a longer mid-portion 112 that can assist in balancing the crossbow 10 to a ground surface. It should be noted that this riser design is may not merely be applicable to a crossbow having a compound bow, for example, the riser design may also be applicable to a crossbow having other bow designs when applied with sound judgment by a person of ordinary skill in the art.

With reference now to FIGS. 1-4 and 13-20, a wheel design according to one implementation will now be described. A wheel 38 may have a first and a second side 82, 84 and an opening 86 (referenced in FIG. 16). In one implementation, the opening 86 can be used to receive a shaft 88 that is operatively coupled with the limbs 36 of the crossbow 10. As one example, the wheel 38 may rotate about the shaft 88 any suitable manner chosen with sound judgment by a person of ordinary skill in the art. In one implementation, rather than having the wheel opening 86 rotate directly around the shaft 88, as is commonly known, at least one bushing 90 may be used.

In one implementation, the bushing 90 (e.g., as in FIG. 17) may comprise an opening 92 that rotatably receives the shaft 88. Further, the bushing 90 may comprise a first end 94 that is received within the opening 86 in the wheel 38 and a second end 96 that comprises a flange 100. Additionally, the flange 100 can comprise an outer diameter that is greater than the outer diameter of the first end 94. As an example, the flange 100 can contact the first side 82 of the wheel 38. It is to be understood, however, that the outer shape of the bushing 90 may not be circular in cross-section, as shown, but may comprise alternate shapes. In another implementation, a second bushing 90 may be inserted into the opposite end of the wheel opening 86. In this implementation, the flange 100 can contact the second side 84 of the wheel 38.

In still another implementation, there may be a space 102 between the first end 94 of one bushing 90 and the first end 94 of the other bushing 90, for example, when the bushings are properly installed onto the wheel 38. For the implementations shown, for example, respective wheels 38 can comprise a pair of pulleys and may comprise a cam. It should be understood, however, that the bushings described herein may also work with wheels having any number of pulleys and wheels that may or may not comprise a cam. It should be noted that the wheel design may not merely be applicable to a crossbow but may also apply to a compound bow when applied with sound judgment by a person of ordinary skill in the art.

The word "exemplary" is used herein to mean serving as an example, instance or illustration. Any aspect or design described herein as "exemplary" is not necessarily to be construed as advantageous over other aspects or designs. Rather, use of the word exemplary is intended to present concepts in a concrete fashion. As used in this application, the term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. Further, at least one of A and B and/or the like generally means A or B or both A and B. In addition, the articles "a" and "an" as used in this application and the appended claims may generally be construed to mean "one or more" unless specified otherwise or clear from context to be directed to a singular form.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims. Of course, those skilled in the art will recognize many modifications may be made to this configuration without departing from the scope or spirit of the claimed subject matter.

Also, although the disclosure has been shown and described with respect to one or more implementations, equivalent alterations and modifications will occur to others skilled in the art based upon a reading and understanding of this specification and the annexed drawings. The disclosure includes all such modifications and alterations and is limited only by the scope of the following claims. In particular regard to the various functions performed by the above described components (e.g., elements, resources, etc.), the terms used to describe such components are intended to correspond, unless otherwise indicated, to any component which performs the specified function of the described component (e.g., that is functionally equivalent), even though not structurally equivalent to the disclosed structure which performs the function in the herein illustrated exemplary implementations of the disclosure.

In addition, while a particular feature of the disclosure may have been disclosed with respect to only one of several implementations, such feature may be combined with one or more other features of the other implementations as may be desired and advantageous for any given or particular application. Furthermore, to the extent that the terms "includes," "having," "has," "with," or variants thereof are used in either the detailed description or the claims, such terms are intended to be inclusive in a manner similar to the term "comprising."

The implementations have been described, hereinabove. It will be apparent to those skilled in the art that the above methods and apparatuses may incorporate changes and modifications without departing from the general scope of this invention. It is intended to include all such modifications and alterations in so far as they come within the scope of the appended claims or the equivalents thereof.

We claim:

1. A crossbow riser comprising:

a plurality of cells defined by walls wherein, said walls consisting essentially of a material wherein the yield tensile strength at 0.2% strain is greater than 780 MPa, and either the specific strength is greater than 200 kNm/kg, or the density is less than 6.0 g/cc; and said cells collectively define a first volume, said walls collectively define a second volume, and the ratio of said first volume to said second volume is greater than 1.5.

2. The crossbow riser of claim 1, wherein said yield tensile strength at 0.2% strain is greater than 900 MPa.

3. The crossbow riser of claim 2, wherein said ratio of said first volume to said second volume is greater than 3.0.

4. The crossbow riser of claim 3, wherein said specific strength is greater than 210 kNm/kg, or said density is less than 5.5 g/cc.

5. The crossbow riser of claim 4, wherein said yield tensile strength at 0.2% strain is greater than 1000 MPa.

6. The crossbow riser of claim 5, wherein said the ratio of said first volume to said second volume is greater than 4.5.

7. The crossbow riser of claim 6, wherein said specific strength is greater than 230 kNm/kg, or said density of less than 4.5 g/cc.

8. The crossbow riser of claim 7, wherein said yield tensile strength at 0.2% strain is greater than 1200 MPa.

9. The crossbow riser of claim 8, wherein said the ratio of said first volume to said second volume is greater than 6.0.

10. A crossbow comprising:

a bowstring movable between a cocked position and an uncocked position, said cocked position defining an operational plane; and a riser comprising a planar upper surface substantially parallel to said operational plane and a planar lower surface; and a set of one or more cells defined by a set of one or more walls, each of said one or more cells being in communication with both said upper surface and said lower surface, each of said set of one or more cells and said one or more walls having a cross-sectional area defined by a sectional plane parallel to said upper surface that is substantially constant along a dimension normal to said upper surface, and wherein the ratio of the area of the set of one or more cells to the area of the set of one or more walls is greater than 2.0.

11. The crossbow of claim 10, wherein the ratio of the area of the set of one or more cells to the area of the set of one or more walls is greater than 3.0.

12. The crossbow of claim 11, wherein the ratio of the area of the set of one or more cells to the area of the set of one or more walls is greater than 4.0.

13. The crossbow of claim 12, wherein the ratio of the area of the set of one or more cells to the area of the set of one or more walls is greater than 5.0.

14. The crossbow of claim 13, wherein the ratio of the area of the set of one or more cells to the area of the set of one or more walls is greater than 6.0.

15. A crossbow comprising:

a main beam;

a riser comprising: (1) a connection portion that connects said riser to said main beam; (2) a first limb holder; (3) a second limb holder; and, (4) one or more through holes configured to create a bulk density of less than 4.5 g/cc for said riser; and, a bow comprising: (1) a first limb comprising a first end supported to said first limb holder and a second end; (2) a second limb comprising a first end supported to said second limb holder and a second end; and, (3) a bowstring that is: (a) operatively received by said second ends of said first and second limbs; and, (b) moveable between an uncocked position and a cocked position to propel an associated arrow away from said crossbow.

16. The crossbow of claim 15, wherein said one or more through holes are configured to create a bulk density of less than 2.3 g/cc.

17. The crossbow of claim 15, wherein said one or more through holes are configured to create a bulk density of less than 1.5 g/cc.

18. The crossbow of claim 15, wherein said one or more through holes are defined by one or more walls, said walls comprising one or more of: a carbon fiber composite material; an aluminum-based material; and a titanium-based material.

19. The crossbow of claim 15 wherein said riser comprises:

a mid-section defining said connection portion;

a first side that: (1) extends outwardly from a first side of said main beam; and, (2) comprises at least a first of said through holes; and, a second side that: (1) extends outwardly from a second side of said main beam;

and, (2) comprises at least a second of said through holes.

20. The crossbow of claim 15 wherein said riser comprises:

a mid-section defining said connection portion;

a first side that: (1) extends outwardly from a first side of said main beam; and, (2) comprises at least first and second of said through holes; and, a second side that: (1) extends outwardly from a second side of said main beam; and, (2) comprises at least third and fourth of said through holes.

* * * * *